US010343447B2

(12) United States Patent
Ojan

(10) Patent No.: US 10,343,447 B2
(45) Date of Patent: Jul. 9, 2019

(54) MOISTURE PAD

(71) Applicant: Sahar Dawn Ojan, Warminster, PA (US)

(72) Inventor: Sahar Dawn Ojan, Warminster, PA (US)

( * ) Notice: Subject to any disclaimer, the term of this patent is extended or adjusted under 35 U.S.C. 154(b) by 273 days.

(21) Appl. No.: 15/405,267

(22) Filed: Jan. 12, 2017

(65) Prior Publication Data

US 2017/0197456 A1 Jul. 13, 2017

Related U.S. Application Data

(60) Provisional application No. 62/384,680, filed on Sep. 7, 2016, provisional application No. 62/278,388, filed on Jan. 13, 2016.

(51) Int. Cl.
*B43M 11/04* (2006.01)
*B43M 11/00* (2006.01)

(52) U.S. Cl.
CPC ..... *B43M 11/04* (2013.01); *B43M 11/00* (2013.01)

(58) Field of Classification Search
CPC ..... B43M 11/04; B43M 11/00
See application file for complete search history.

(56) References Cited

U.S. PATENT DOCUMENTS 1,467,040 A * 9/1923 Jerabek ..... B43M 11/04 118/201
1,949,865 A * 3/1934 Horton ..... B43M 11/04 118/267
2,554,302 A * 5/1951 Keskitalo ..... B43M 1/00 118/268
2,658,474 A * 11/1953 Kuehn ..... B43M 11/04 118/264
2,741,219 A * 4/1956 Montalcini ..... B43M 11/04 118/264
2,876,735 A * 3/1959 Link ..... B43M 11/04 118/266
2,932,277 A * 4/1960 Borah ..... B43M 11/04 118/270
3,082,736 A * 3/1963 Waters ..... B43M 11/04 118/268
4,159,883 A * 7/1979 Mizell ..... A47K 7/03 15/244.4
5,341,538 A * 8/1994 Banome ..... A45D 34/04 15/145
5,433,782 A * 7/1995 Filbert ..... B43M 11/04 118/264
5,704,723 A * 1/1998 Salisian ..... A47K 7/03 401/201
2003/0202838 A1* 10/2003 Sun ..... A45D 34/042 401/202
2012/0060862 A1* 3/2012 Van Tran ..... A47K 7/03 134/6

FOREIGN PATENT DOCUMENTS

GB 275517 A * 8/1927 ..... B43M 11/04

* cited by examiner

*Primary Examiner* — Christopher R Harmon

(57) ABSTRACT

A moisture pad includes a porous pad, for example a sponge; a water bladder or reservoir; and a container for securely supporting the porous pad and the reservoir. Optionally, a lid may be provided as a closure for the container to reduce evaporation of the water. As another option, a strap can be provided for the container to allow the moisture pad to be worn on a person's body.

12 Claims, 32 Drawing Sheets

MOISTURE PAD

BACKGROUND OF THE INVENTION

1. Field of the Invention

The present invention relates to a moisture pad for wetting one's fingers for a better grip or for moistening the adhesive of an envelope flap or the like.

2. Description of the Prior Art

People find that moistening their fingers affords them a better grip when handling sheets of material such as paper or plastic, allowing them to more easily separate sheets of such materials. For example, when turning the pages of a book or counting paper money, people are commonly observed moistening their fingers with their saliva to allow them to more easily separate the sheets of paper. The same technique is also applied when opening plastic bags at the grocery store. However, such practices are unhygienic, and many people that may have to handle an item, after it is handled by a person who moistened their fingers with their saliva, find such practices objectionable.

Moist sponges placed in open containers are often placed on post office counters for patrons to use for moistening the flaps of the envelopes to activate the pre-applied adhesive. Also, tubes of fluid adhesives with sponge applicators at the tips are known for the purpose of activating the pre-applied adhesive of the flaps of the envelopes. However, these fluid adhesives leave a tacky residue that makes them unsuitable for moistening fingers, and the open containers with wet sponges cannot be conveniently carried on a person as they go about their daily activities. The need persists for a device that allows a person to moisten their fingers in a more hygienic manner and that can be conveniently carried on a person as they go about their daily activities.

SUMMARY OF THE INVENTION

The present invention is directed to a moisture pad that is easily portable. The moisture pad includes a porous pad, for example a sponge; a water bladder or reservoir; and a container for securely supporting the porous pad and the reservoir. Optionally, a lid may be provided as a closure for the container to reduce evaporation of the water. As another option, a strap can be provided for the container to allow the moisture pad to be worn on a person's body. The strap can, for example, be a wrist strap or an upper arm strap. The reservoir is preferably provided with a closable filing opening. The porous pad may be placed over the top of the reservoir or to one side of the reservoir. The reservoir is provided with a check valve that allows water to be dispensed to the porous pad when the reservoir is squeezed. The check valve is normally closed to prevent water loss from the reservoir. The user can squeeze the reservoir by pressing on it to pressurize the contents and thus open the check valve to allow water to be applied to the porous pad as necessary to wet the pad when desired.

The check valve, also known as a one-way valve, can be of any suitable type such as, for example, a caged ball check valve; a spring biased, caged ball check valve; or a flexible flap check valve of molded rubber that is self-biased or internally biased to assume the closed configuration, which is also referred to as a slit valve herein. A tube may be provided to convey water from the check valve to at least the proximity of the porous pad within the container. The outlet of the tube may even be in contact with or extend into the porous pad.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
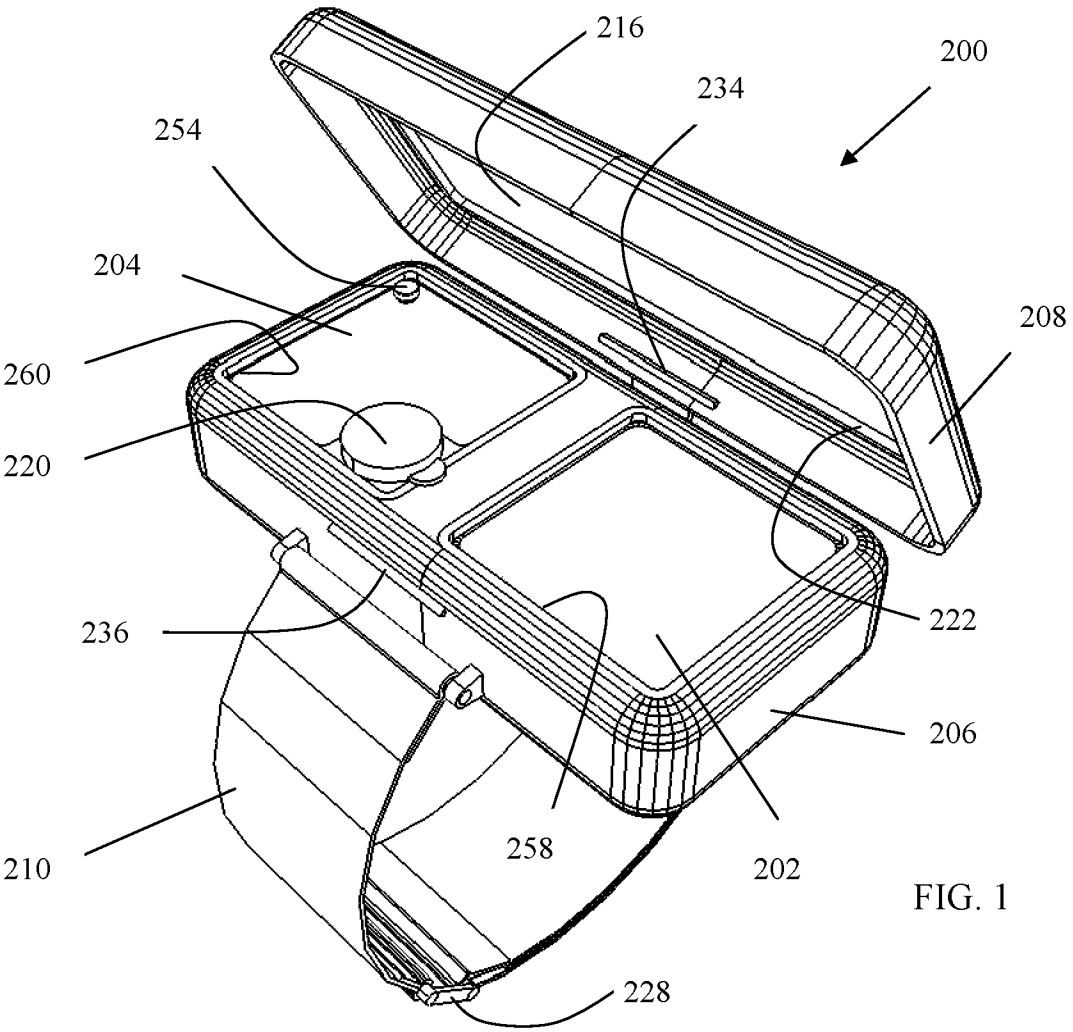
FIGS. 1-3 are views of a first embodiment of the moisture pad according to the present invention.
Figure 2:
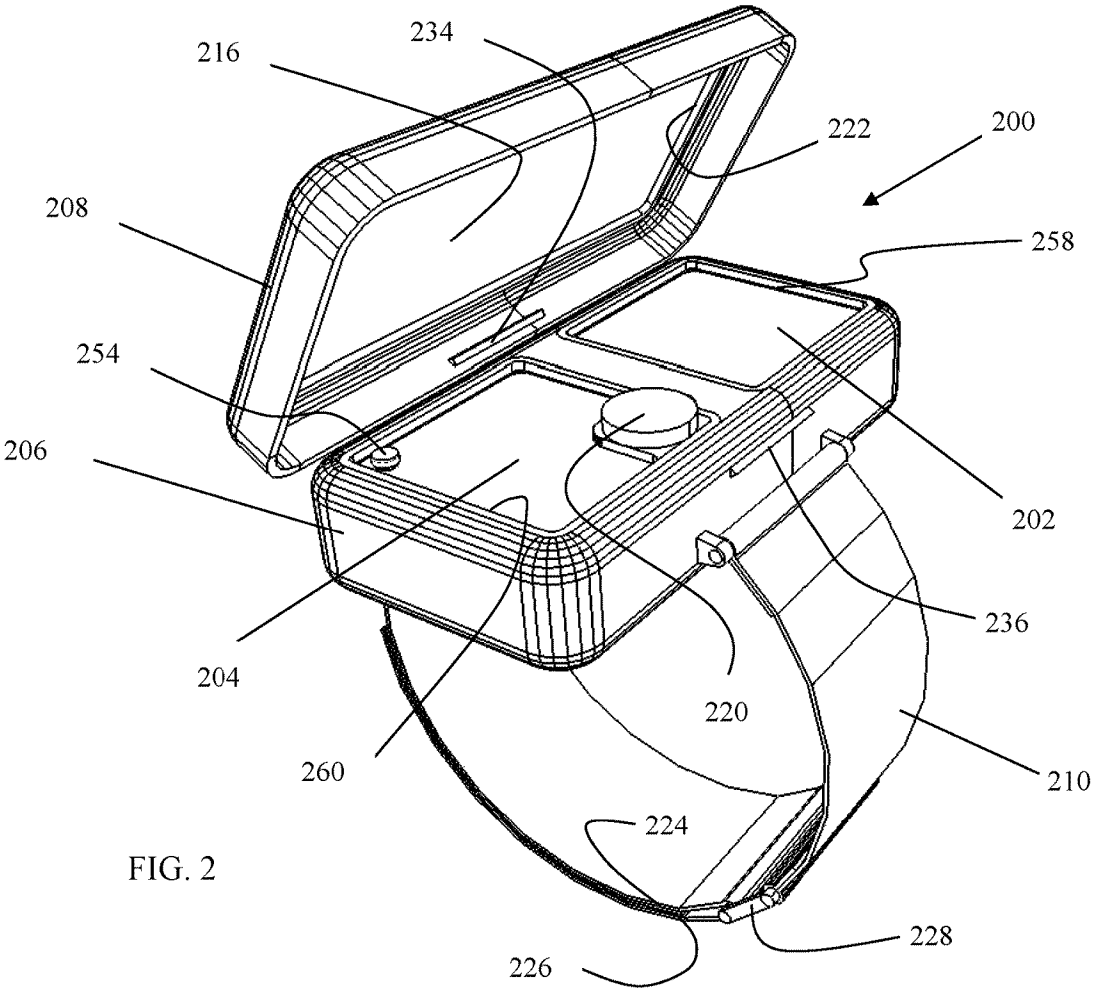
Figure 3:
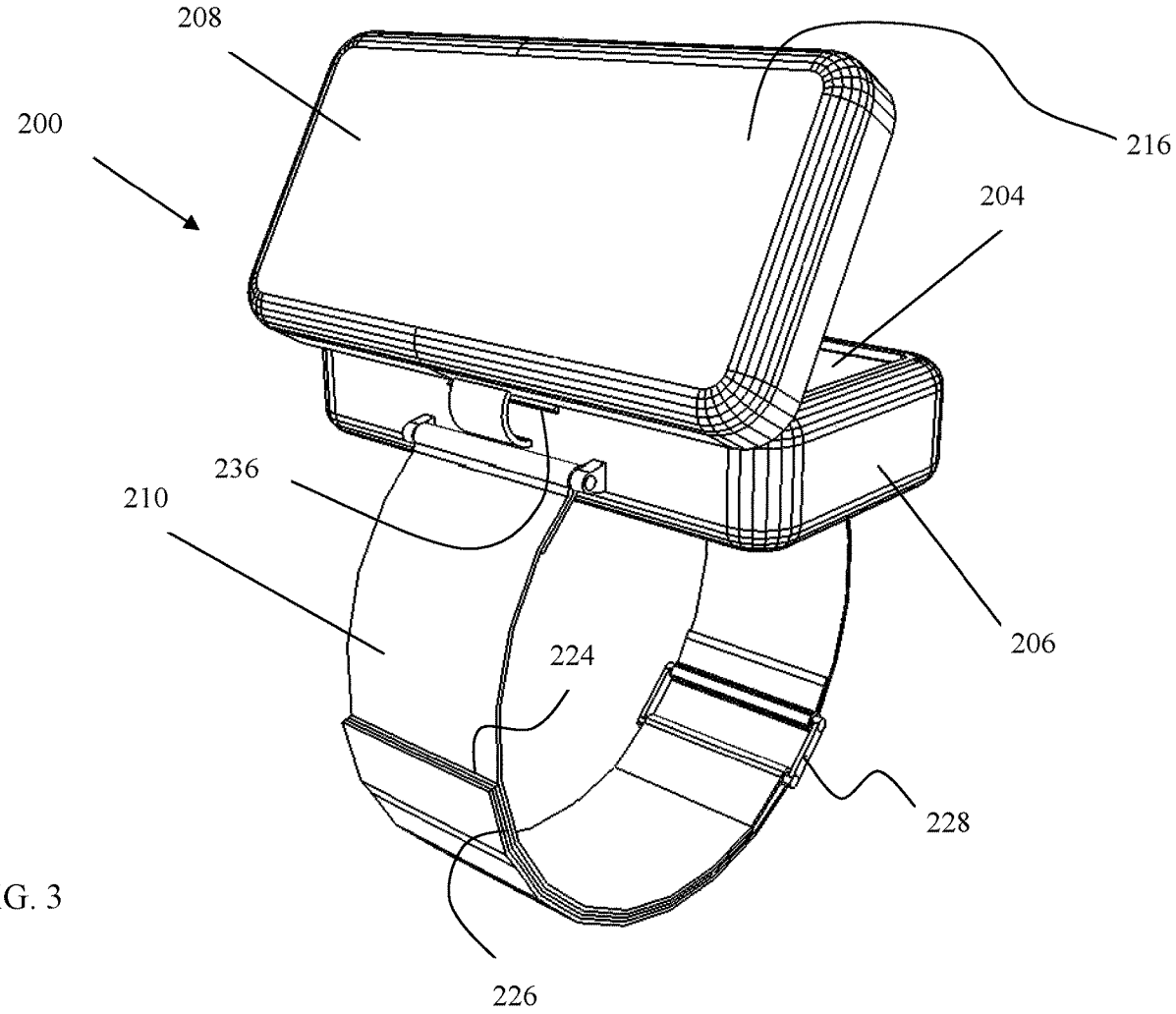
Figure 4:
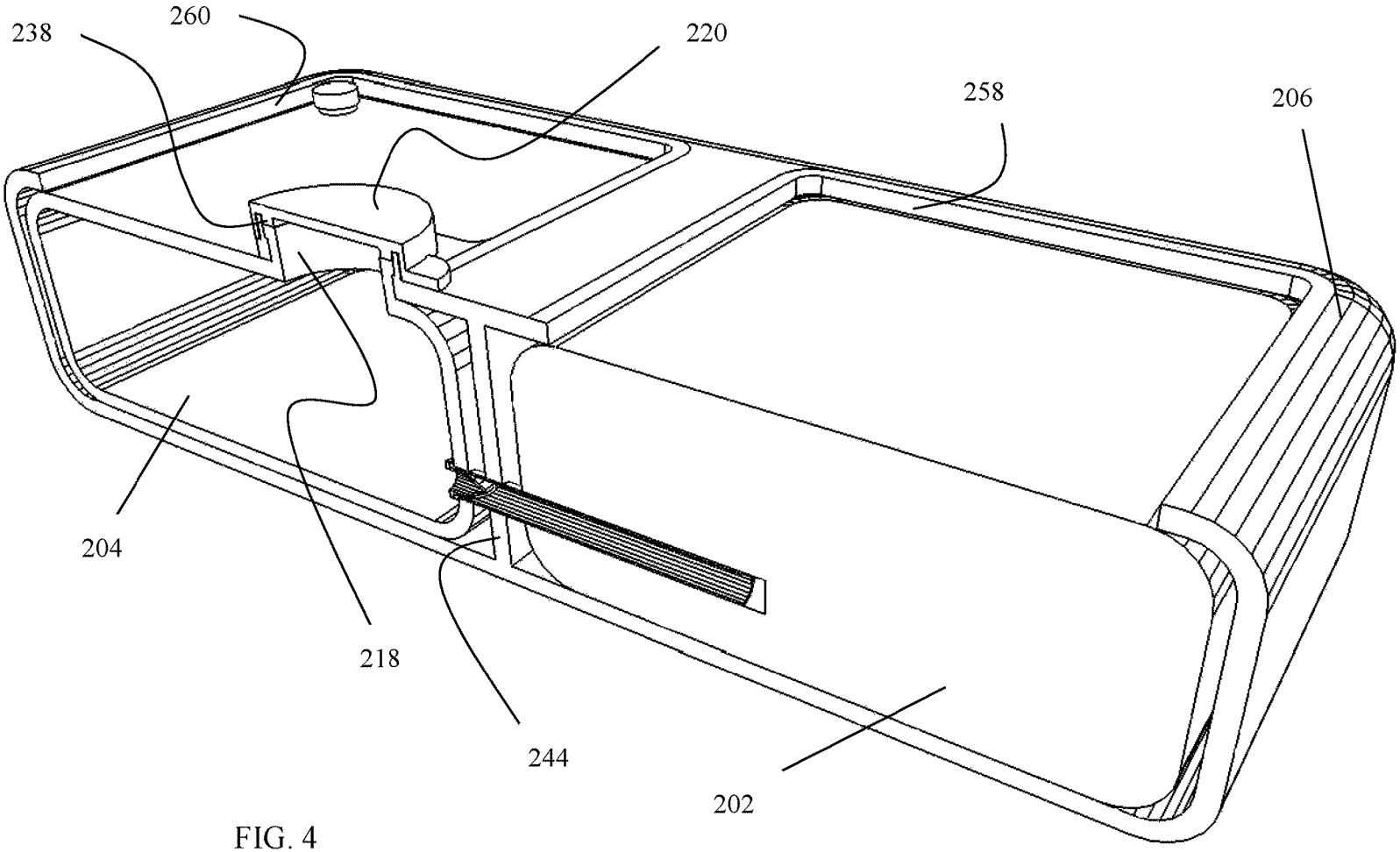
FIGS. 4-5 are sectioned views of the first embodiment of the moisture pad according to the present invention showing the one-way valve for controlling water flow to the sponge in the closed configuration.
Figure 5:
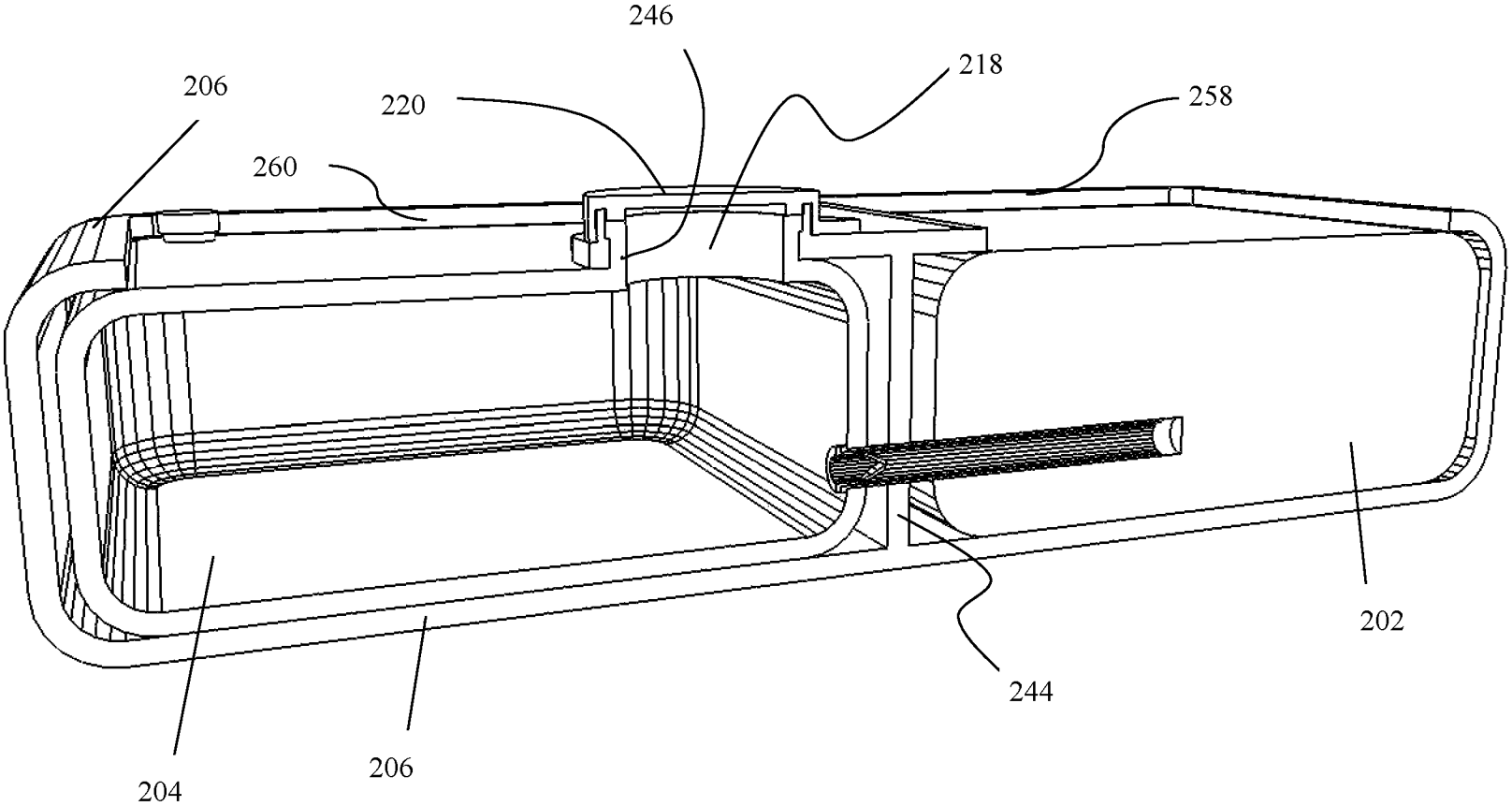
Figure 6:
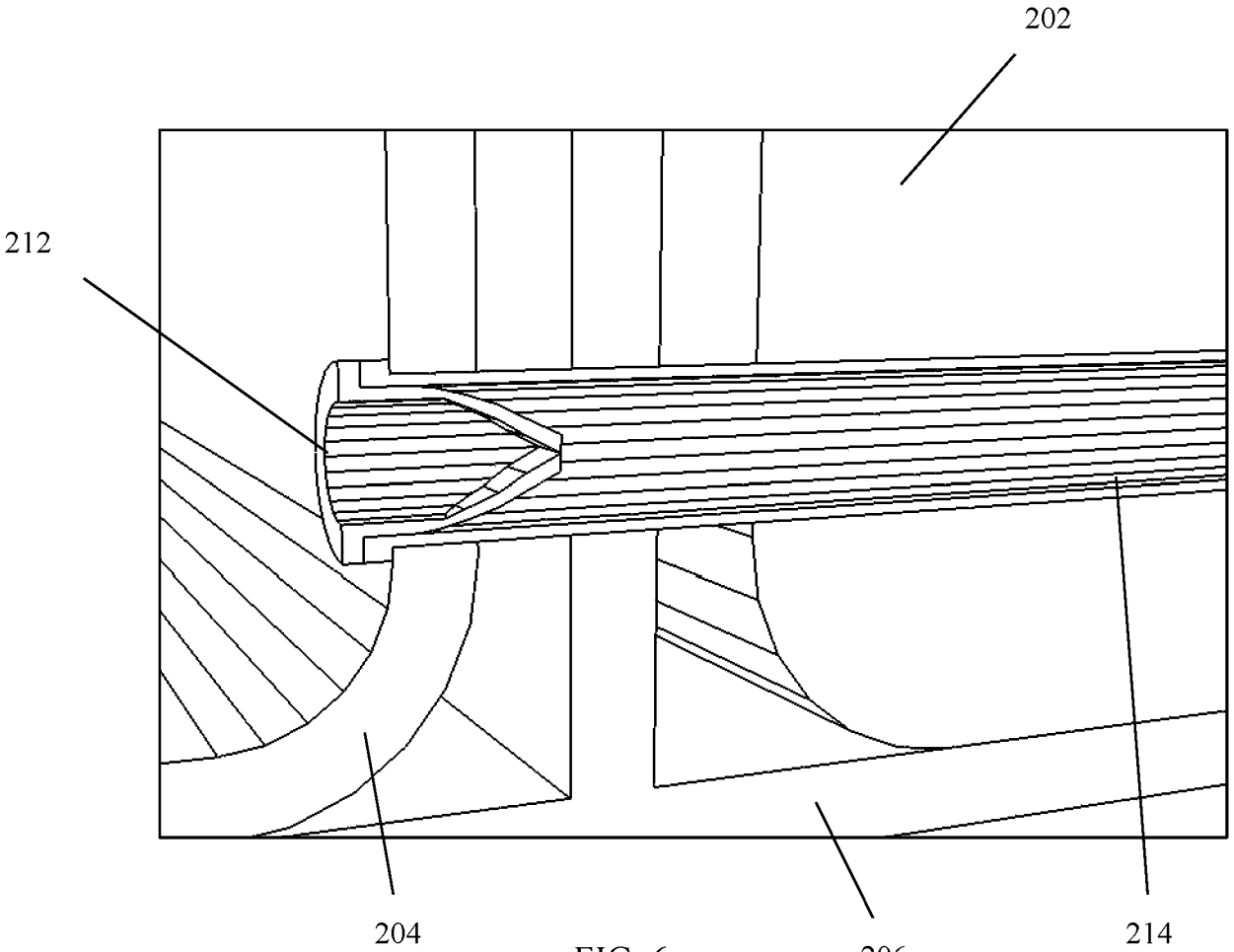
FIG. 6 is a fragmentary view of the first embodiment of the moisture pad according to the present invention showing an enlarged view of the one-way valve for controlling water flow to the sponge in the closed configuration.
Figure 7:
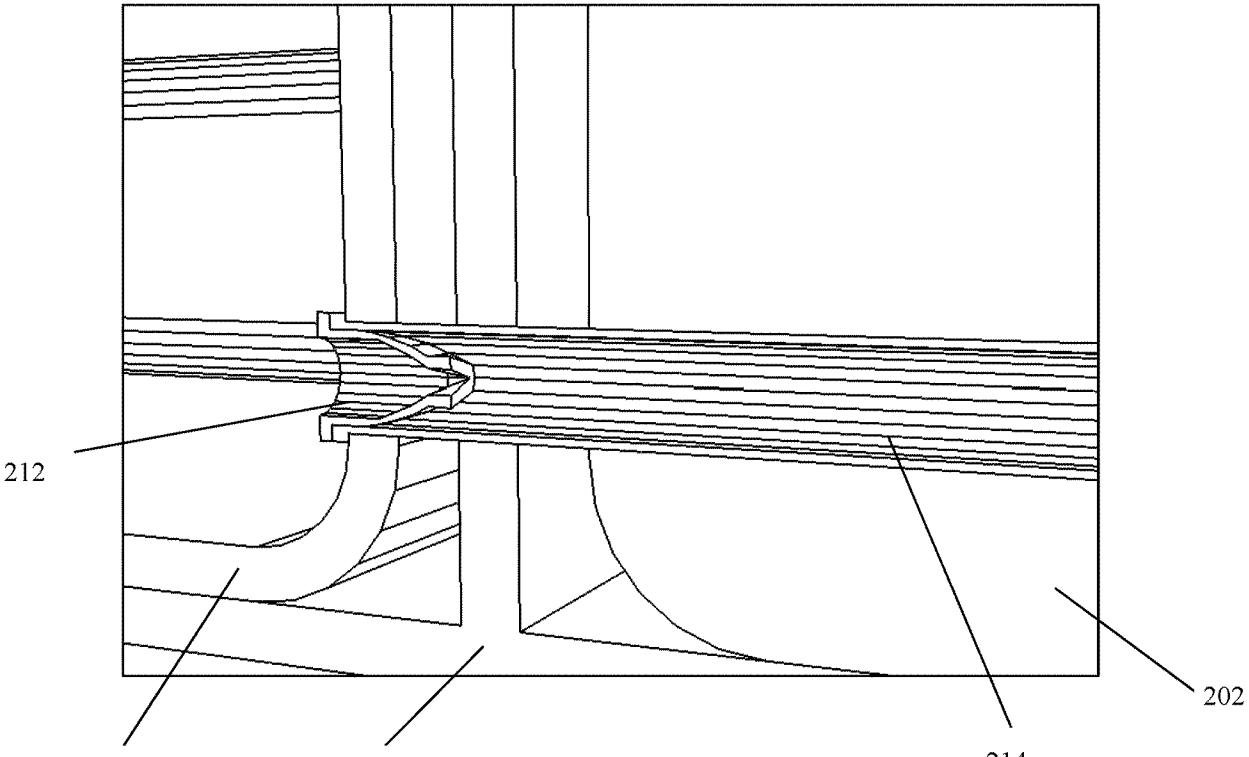
FIG. 7 is a fragmentary view of the first embodiment of the moisture pad according to the present invention showing an enlarged view of the one-way valve for controlling water flow to the sponge in the open configuration.

Referring to FIGS. 1-11, the present invention is directed to a moisture pad 200 that is easily portable. The moisture pad 200 includes a porous pad 202, for example a sponge; a water bladder or reservoir 204; and a container 206 for securely supporting the porous pad 202 and the reservoir 204.

Optionally, a lid 208 may be provided as a closure for the container 206 to reduce evaporation of the water. The lid 208 may be hinged or tethered to the container 206. A gasket 222 attached around the periphery of the lid 208, or provided on the surface of the container 206 that engages the periphery of the lid 208, is preferably provided between the lid 208 and the container 206 to seal gaps between the lid 208 and the container 206 in order to reduce evaporation. In the illustrated embodiment, the gasket 222 is attached around the periphery of the back plate 216 of the lid 208. The lid 208 is preferably provided with fastening means to secure the lid 208 to the container 206 in the closed position. The fastening means for releasably securing the lid 208 in the closed position relative to the container 206 can be of any suitable type. In the illustrated embodiment, the fastening means includes one or more raised ribs 234 that are part of the lid 208 and that snap over one or more corresponding raised ribs 236 of the container 206 to releasably secure the lid 208 in the closed position relative to the container 206. When the lid 208 is open, the porous pad 202 can be accessed by the user so that the user can press the porous pad 202 with one or more of his or her fingers in order to wet or moisten his or her fingers. With the lid 208 in the open position, the reservoir 204 can also be accessed by the user so that the user can squeeze or press the reservoir 204 with one or more of his or her fingers in order to transfer water from the reservoir 204 to the porous pad 202 in order to wet or moisten the porous pad 202 when needed.

In the embodiment illustrated in FIGS. 1-11, the container 206 has two side by side compartments, one for the porous pad 202 and one for the reservoir 204. The two compartments of the container 206 are separated by a wall 244. The wall 244 may be removed such that the porous pad 202 and the reservoir 204 are placed side by side in the same compartment. The container 206 has two top openings 258 and 260 that allow a user to press or squeeze the porous pad 202 and the reservoir 204, respectively, with at least one finger.

As another option, a strap 210 can be provided for the container 206 to allow the moisture pad 200 to be worn on a person's body. The strap 210 can, for example, be used to attach the moisture pad 200 to a person's wrist or upper arm. The strap 210 uses hook and loop fastener portions 224 and 226 that allows one portion of the strap 210 to be fastened on to itself after it has been routed through the ring or loop 228. Alternatively, the strap 210 may employ a buckle that cooperates with perforations in at least a portion of the strap to fasten the strap around the wearer's wrist in the same manner as a watch band. The strap 210 may be of one-piece or two-piece construction.

Figure 16:
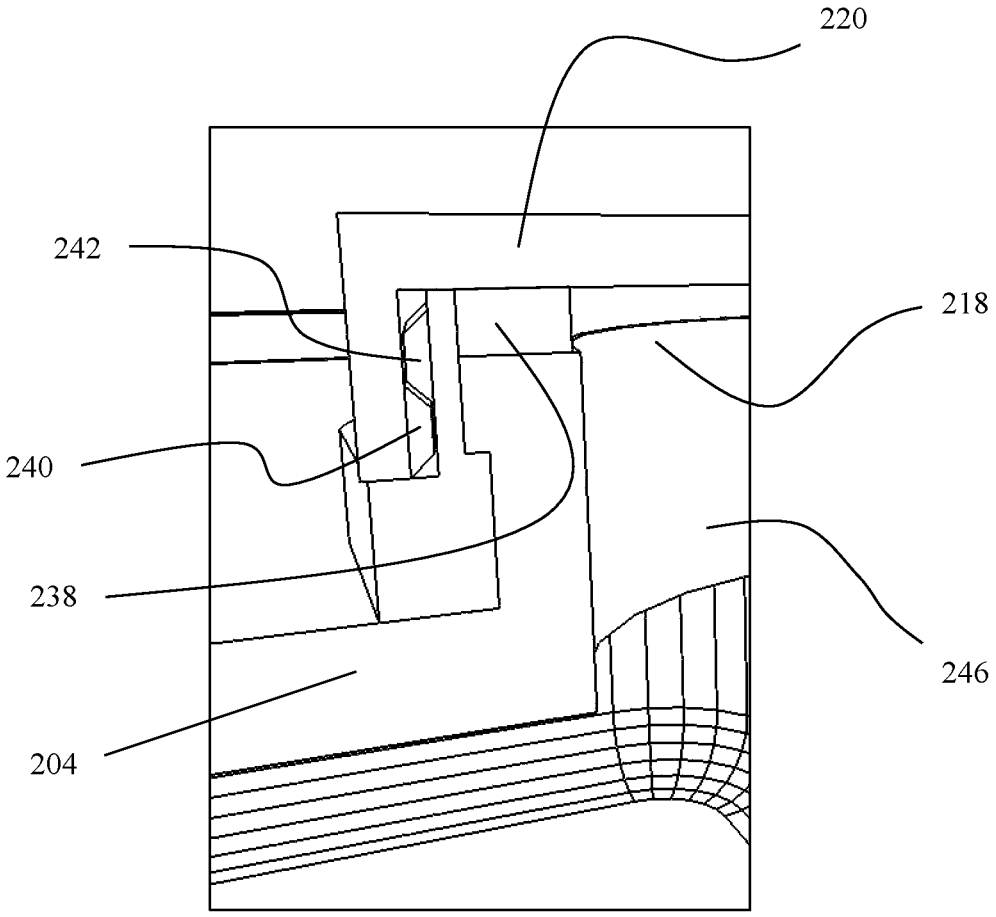
FIG. 16 is a fragmentary view showing details of the ribs for securing the cap for the filling hole of the reservoir in the closed position in accordance with the present invention.

The reservoir 204 is preferably provided with a closable filing opening 218 that is provided with a cap 220. The cap 220 may be hinged or tethered to the container 206 or the reservoir 204. A gasket 238 is preferably provided between the cap 220 and the container 206 or the reservoir 204 to prevent water leakage from the filing opening 218 when the cap 220 is in the closed position. The cap 220 is preferably provided with fastening means to secure the cap 220 in the closed position. The fastening means for releasably securing the cap 220 in the closed position can be of any suitable type provided that it is capable of holding the cap in the closed position with a large enough reaction force such that the cap 220 will not pop off when the reservoir 204 is being pressurized, for example by being squeezed, to transfer water to the porous pad 202. In the illustrated embodiment, the fastening means is a raised rib 240 that is part of the cap 220 and that snaps over a corresponding raised rib 242 on the container 206 to releasably secure the cap 220 in the closed position as shown in FIG. 16. Some other suitable examples for the filling cap fastening means include screw threads or interrupted locking lugs provide on both the cap and on either the container 206 or the filling opening of the reservoir 204 for holding the cap in the closed position over the filling opening of the reservoir 204. When using the interrupted locking lugs, the cap would be closed with a press and twist motion. When the cap 220 is open, the reservoir 204 can be filled. In addition, the raised rib 242 may alternatively be provided on the filling opening of the reservoir 204.

Figure 14:
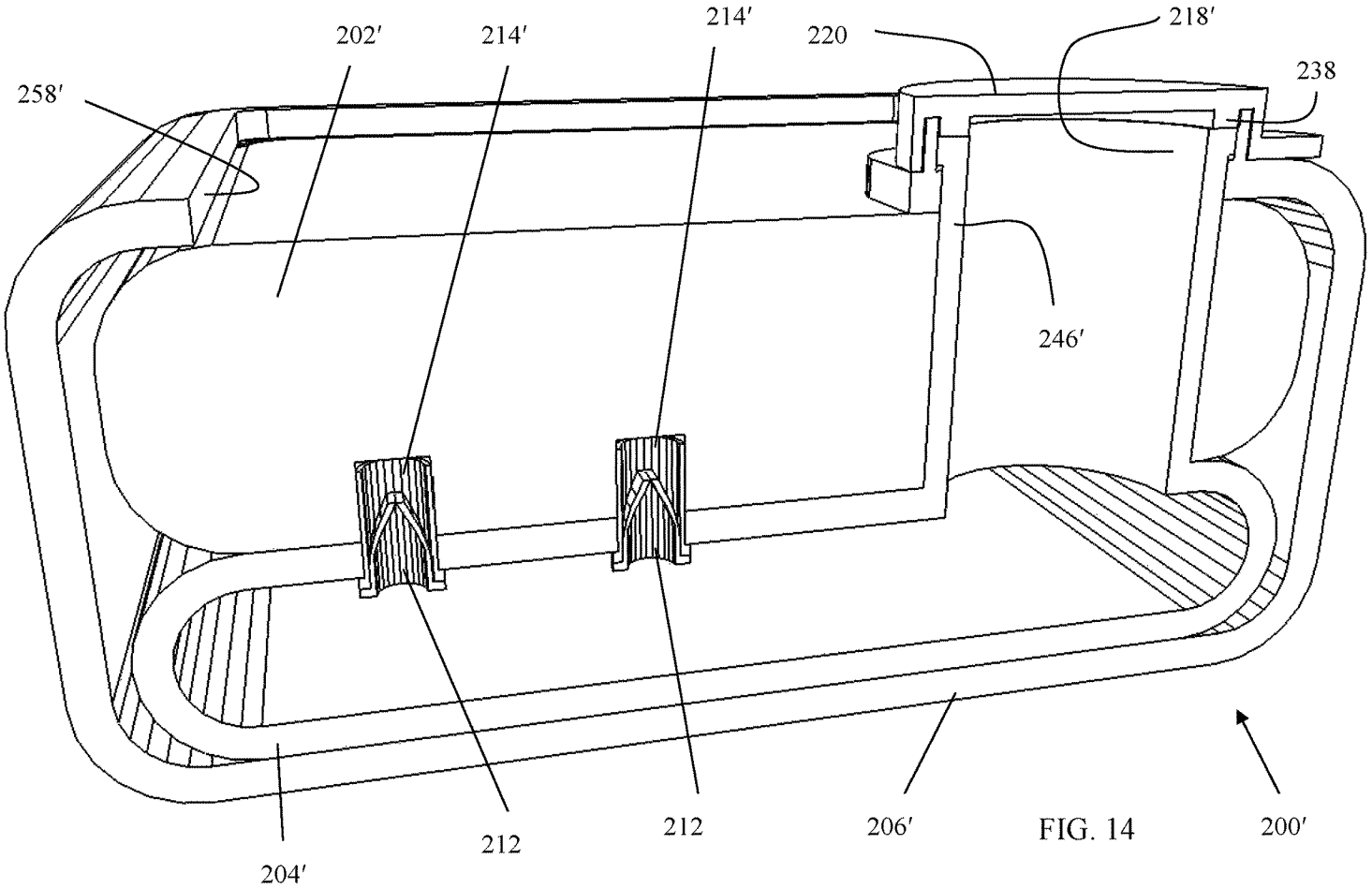
FIGS. 14-15 are views of a third embodiment of the moisture pad according to the present invention, where the sponge is located above the water reservoir, showing the one or more one-way valves for controlling water flow to the sponge in the closed and open configurations, respectively.
Figure 15:
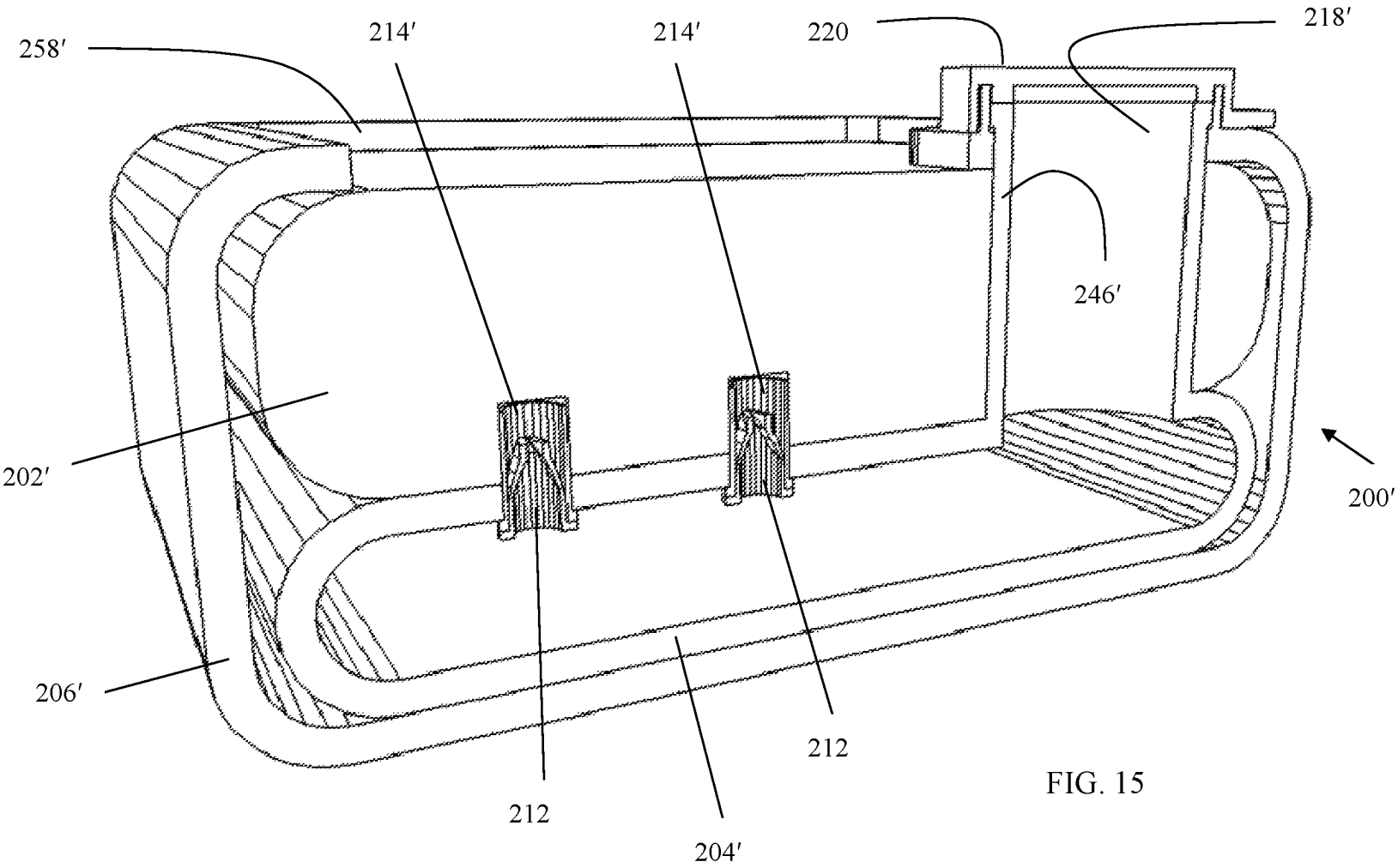

In the illustrated embodiment 200' of FIGS. 14-15, the container 206' has one compartment for both the porous pad 202' and the reservoir 204', with the porous pad 202' being position over the reservoir 204'. The container 206' has one top opening 258' that allows a user to press or squeeze the porous pad 202' and the reservoir 204' simultaneously with at least one finger. Thus, water is supplied to keep the porous pad or sponge 202' moist each time a user presses the sponge 202' to moisten one or more of his or her fingers. Otherwise, the two embodiments are essentially the same. The conduit 246' connecting the reservoir 204' with the filing opening 218' is longer than the conduit 246 connecting the reservoir 204 with the filing opening 218. The types of straps discussed above may be used in either of the illustrated embodiments. The embodiment of FIGS. 14-15 also shows that multiple tubes 214' can be used to supply water from the reservoir to the porous pad. This applies to all the illustrated embodiments.

The porous pad 202, 202' may be placed over the top of the reservoir 204, 204', as shown in FIGS. 14-15, or to one side of the reservoir 204, 204'. The reservoir 204, 204' is provided with one or more check valves 212, also referred to herein as a one-way valve, that allows water to be dispensed to the porous pad 202, 202' when the reservoir 204, 204' is squeezed. The one-way valves 212 are normally closed to prevent water loss from the reservoir 204, 204'. The user can squeeze the reservoir 204, 204' by pressing on it, directly in the embodiment of FIGS. 1-11 and indirectly via the porous pad 202' in the embodiment of FIGS. 14-15, to pressurize the contents of the reservoir and thus open the check valves 212 to allow water to be applied to the porous pad 202, 202' as necessary to wet the pad when desired.

Figure 9:
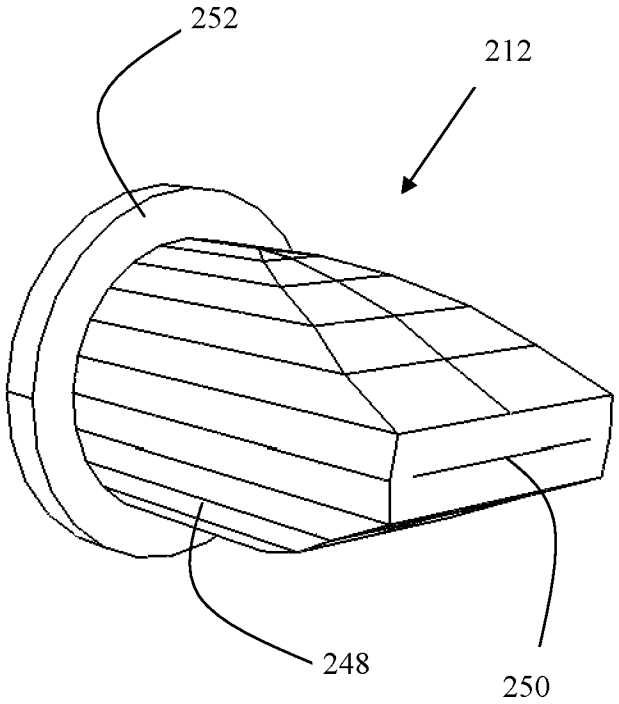
FIGS. 8-9 are perspective views showing the one-way valve for controlling water flow to the sponge in the open and closed configurations, respectively.
Figure 8:
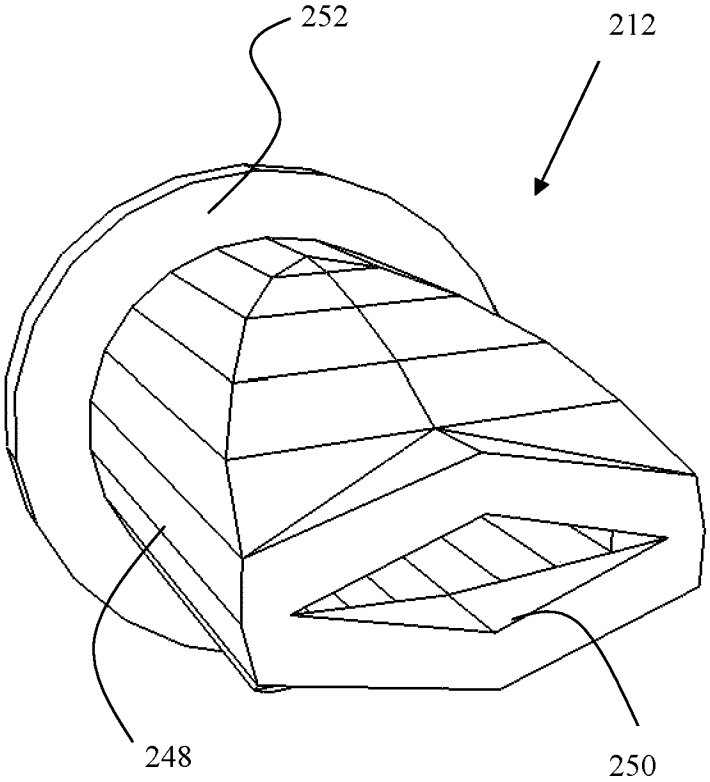
Figure 10:
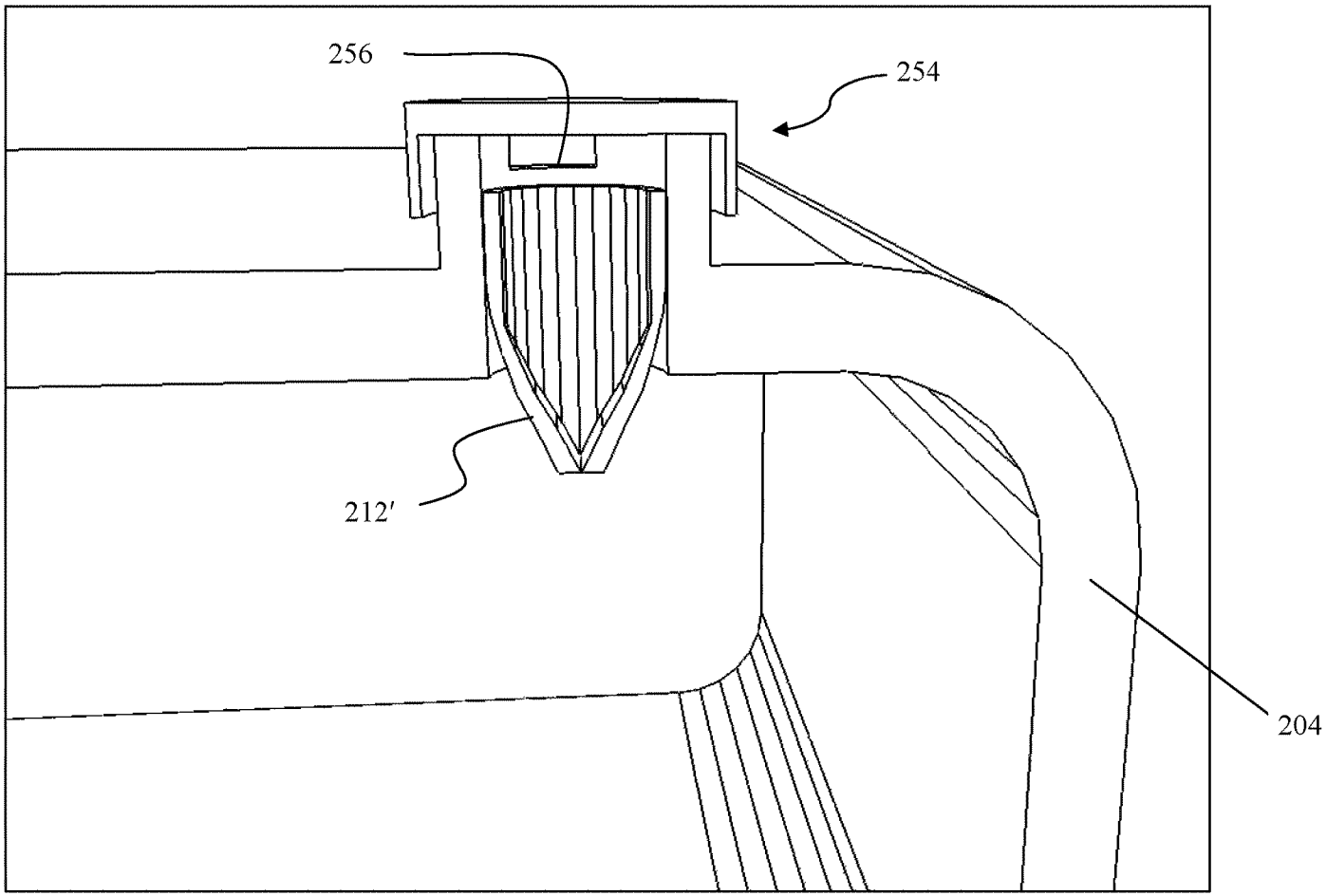
FIG. 10 is a fragmentary view showing details of the optional vent for allowing air into the water reservoir of the moisture pad according to the present invention, with the one-way valve of the vent shown in the closed configuration.
Figure 11:
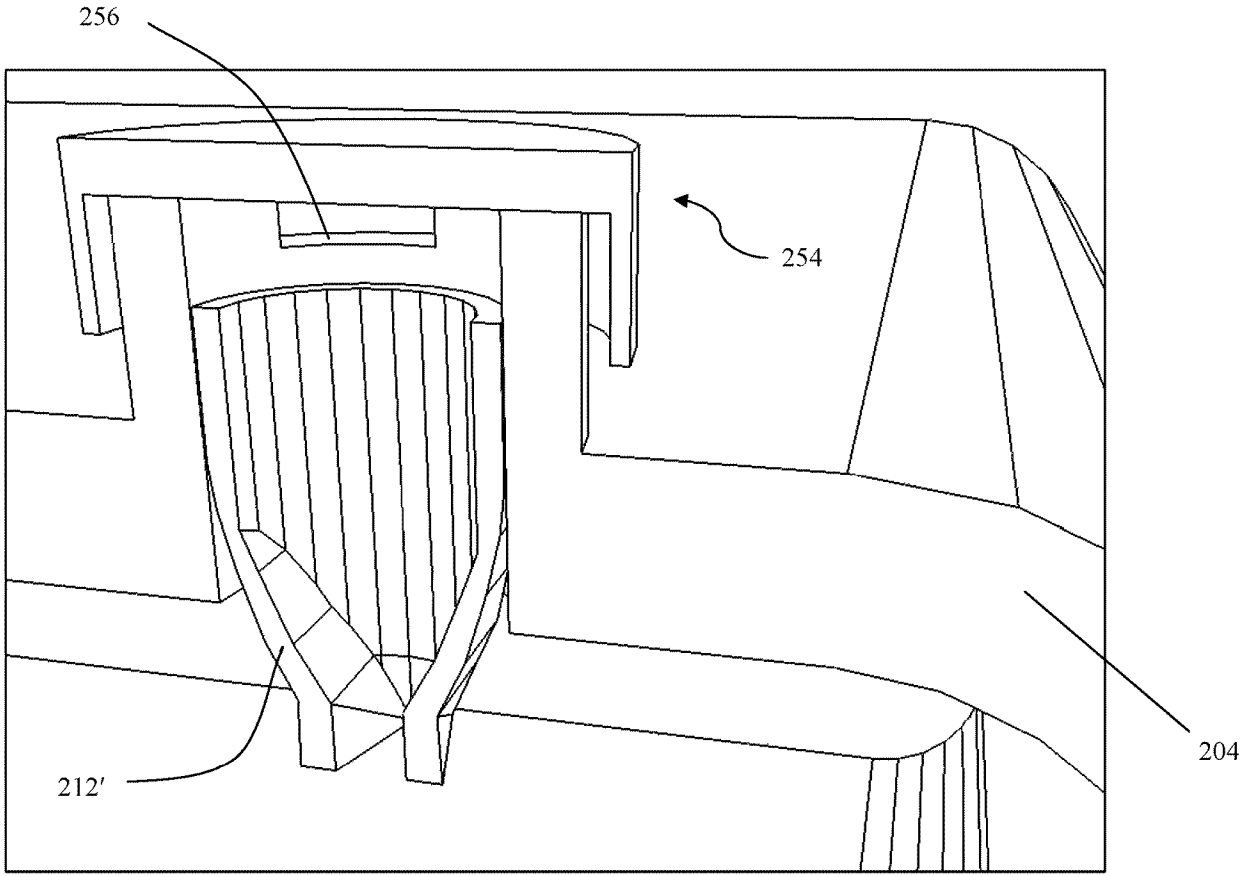
FIG. 11 is a fragmentary view showing details of the optional vent for allowing air into the water reservoir of the moisture pad according to the present invention, with the one-way valve of the vent shown in the open configuration.

The check valves 212 can be of any suitable type such as, for example, a spring biased caged-ball check valve or a flexible flap check valve 212, 212', as illustrated, that is of molded rubber and is self-biased or internally biased to assume the closed configuration. The latter type of valve, illustrated in FIGS. 8 and 9, is also referred to as a slit valve herein. One or more tubes 214, 214' may be provided to convey water from the check valves 212, 212' to at least the proximity of the porous pad 202, 202' within the container 206, 206'. The outlet of the tubes 214, 214' may even be in contact with or extend into the porous pad 202, 202'.

A syringe (not shown) or an eye dropper (not shown), either one with an optional thin, elongated plastic tube at the discharge end, may be used to fill the reservoir 204, 204' with water. Also, the reservoir may be located outside the container 206, 206'. For example, the reservoir may be located on the strap 210. Also, because the lid 208 limits evaporation, the porous pad 202, 202' may remain sufficiently wet for hours without the need for being rewetted or saturated by water from the reservoir 204, 204'. Accordingly, when a supply of water is readily accessible, the reservoir 204, 204' may be eliminated from the moisture pad 200, 200', allowing for a more compact and inexpensive device.

Referring to FIGS. 8 and 9, the one-way valve 212 of the type used in the illustrated embodiments can be seen. The valve 212 has a flexible cylindrical body 248 that is open at the inlet end and has a tapered outlet end that is provided with a slit 250. The valve 212 can be made of a rubber or plastic material. The valve 212 is internally biased such that the slit 250 normally tends to assume the closed configuration shown in FIG. 9. When the pressure at the valve inlet exceeds the pressure at the valve outlet by a threshold value, which is usually a relatively small pressure differential, the slit opens as shown in FIG. 8 and allows fluid to flow through the valve 212. For example, when the water reservoir 204 is pressurized, the valve 212 will open and allow water to pass through the valve from the reservoir 204 to the porous pad 202.

Figure 12:
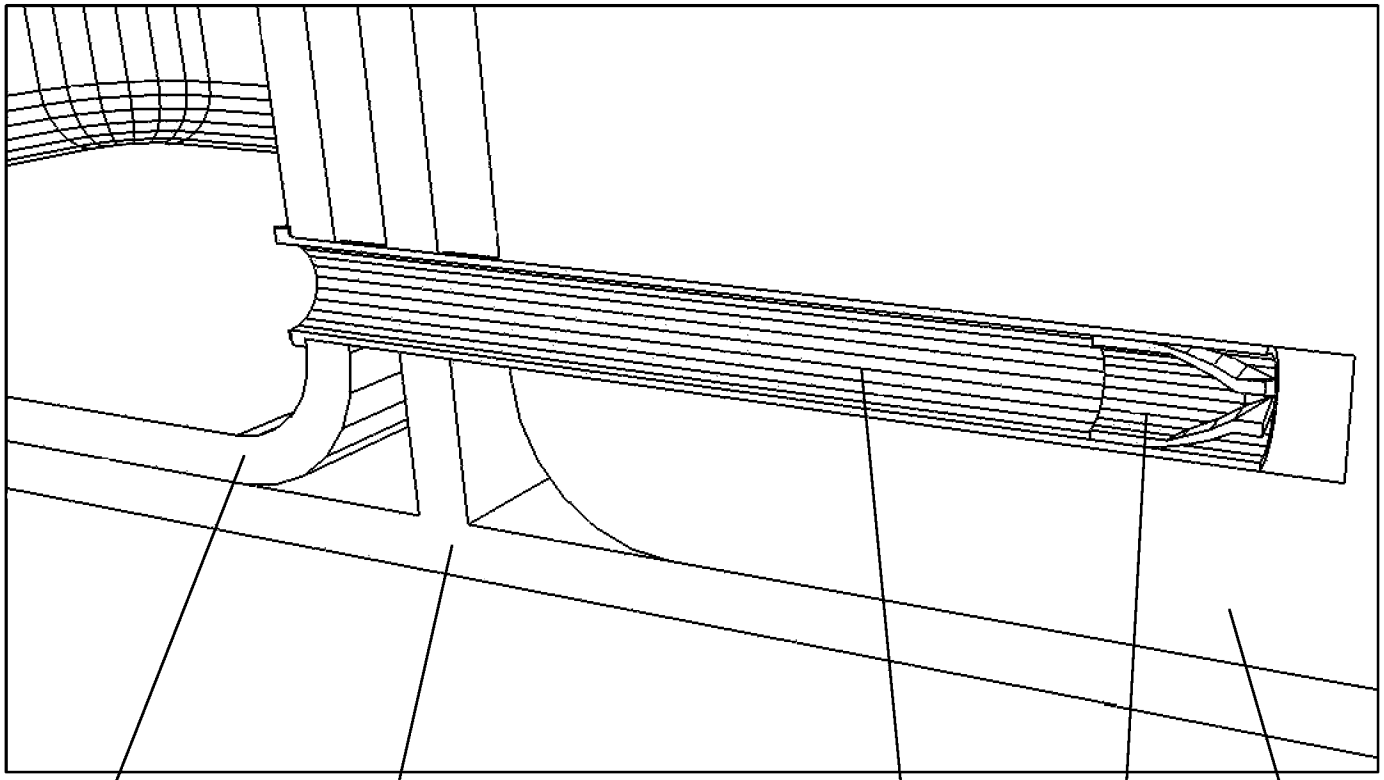
FIG. 12 is a fragmentary view of a second embodiment of the moisture pad according to the present invention showing the one-way valve for controlling water flow to the sponge in the open configuration and located near the outlet end of the tube, for supplying water to the sponge, which is distal from the water reservoir.
Figure 13:
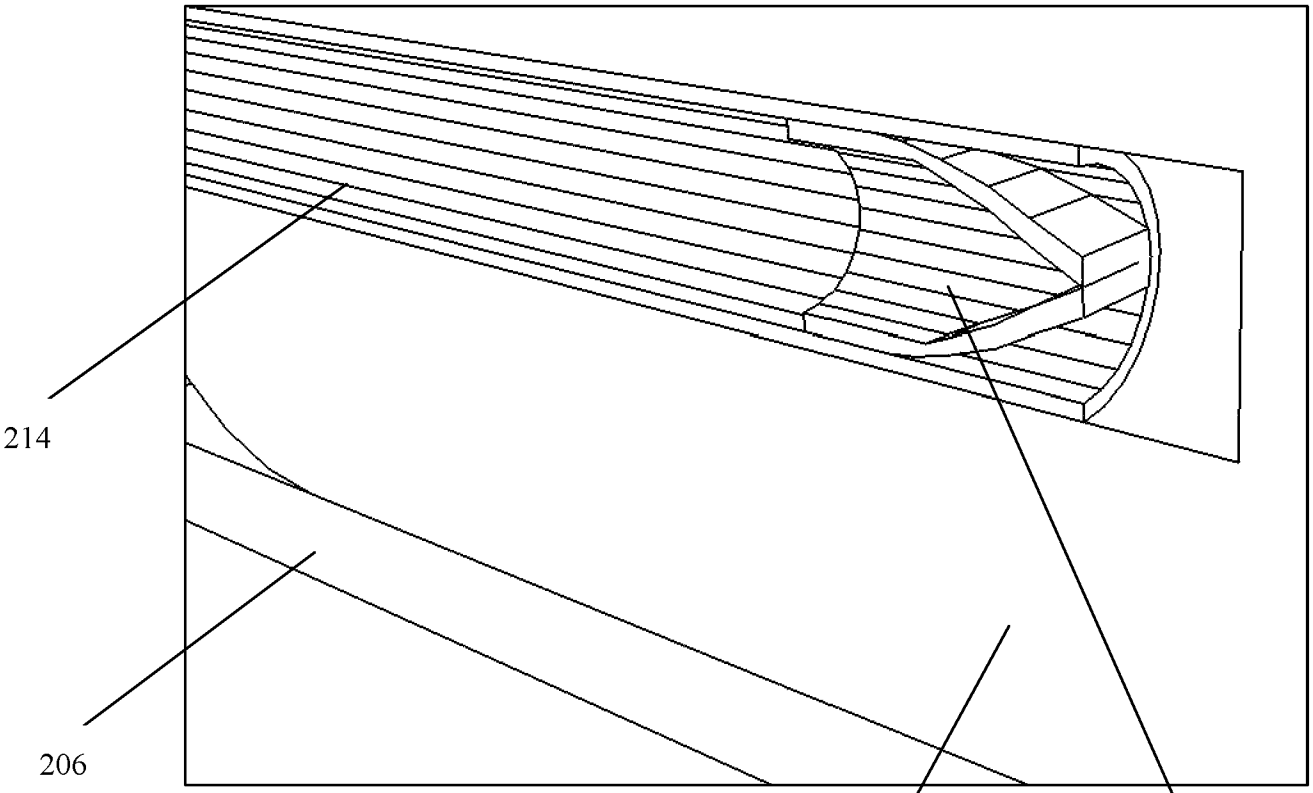
FIG. 13 is a fragmentary view of the second embodiment of the moisture pad according to the present invention showing the one-way valve for controlling water flow to the sponge in the closed configuration and located near the outlet end of the tube, for supplying water to the sponge, which is distal from the water reservoir.

The valve 212 of the illustrated embodiments has a flange 252 at its inlet end to help secure the valve at the inlet end of the tube 214. The valve 212' is identical to the valve 212 except that it lacks the flange 252. The valves 212, 212' can be fixed in place by adhesive, cement or the application of heat and pressure. Also, the valves 212, 212' may be of one-piece construction with the bladder 204, 204' or with the tube 214, 214'. The valves 212, 212' may be located at or near the inlet end of the tubes 214, 214' as illustrated in FIGS. 1-11 and 14-15, the valves 212, 212' may be located at or near the outlet end of the tubes 214, 214' as illustrated in FIGS. 12-13, the valves 212, 212' may be located anywhere between the inlet end and the outlet end of the tubes 214, 214'. However, for ease of assembly, the positions for the valves 212, 212', relative to the tubes 214, 214', shown in the illustrated embodiments are preferred.

Although, as illustrated, the tubes 214, 214' and valves 212, 212' have circular cross sections, it is possible for the tubes 214, 214' and valves 212, 212' to have elongated cross sections that, for example, extend for approximately the inside width of the reservoir 204, 204'. As another alternative design, the tubes 214, 214' may be eliminated altogether and the valves 212, 212' attached directly to the reservoir 204, 204'. The partition wall 244 would then be eliminated, and the valves 212, 212' would then allow water to enter the interior of the housing, responsive to user input, where it can be absorbed by the porous pad 202, 202'.

Referring to FIGS. 1-11, the moisture pad 200 may be provided with an optional vent 254 that allows the reservoir 204 to re-inflate after each emission of water from the reservoir 204 to the porous pad 202. The vent 254 is provided with openings 256 to the atmosphere and a one-way valve 212' that allows air to enter the reservoir 204 but that prevents water from leaking out of the reservoir. When the pressure inside the reservoir 204 is sufficiently below atmospheric pressure, such as when water has just been supplied or emitted from the reservoir to the porous pad 202, the valve 212' of the vent opens to allow air to enter the reservoir as the reservoir 204 re-inflates under its own internal bias or elasticity. When the pressure inside the reservoir 204 is at or above atmospheric pressure, such as when the reservoir 204 is being squeezed to supply water to the porous pad 202, the valve 212' of the vent remains closed to prevent water leakage through the vent 254. The vent 254 may optionally be used with all the various illustrated embodiments.

The vent 254 is not necessary for the successful operation of the moisture pad 200. If the vent 254 is not provided for the reservoir 204, the reservoir 204 will collapse further and remain collapsed with each emission of water from the reservoir 204; thus, providing a visual indication of the amount of water remaining in the reservoir and of the need for refilling the reservoir. Preferably, the reservoir 204, 204' is made of a transparent polymeric or elastomeric material to allow a user to determine the amount of water remaining in the reservoir, or whether or not the reservoir needs refilling, by visual inspection.

As yet another alternative design, the reservoir 204 can be made rigid. The moisture pad would then be provided with a push button or pressure pad that would be accessible from the exterior of the housing 206 that would operate or actuate a pump mechanism, such as the kind that is used in conventional spray bottles for example, provided inside the housing 206. Spray nozzles or a tube such as tube 214, supported by the partition 244, would then provide water to the porous pad 202 when the pump mechanism is actuated using the push button. A rigid reservoir would particularly benefit from a vent such as, for example, the vent 254.

Figure 17:
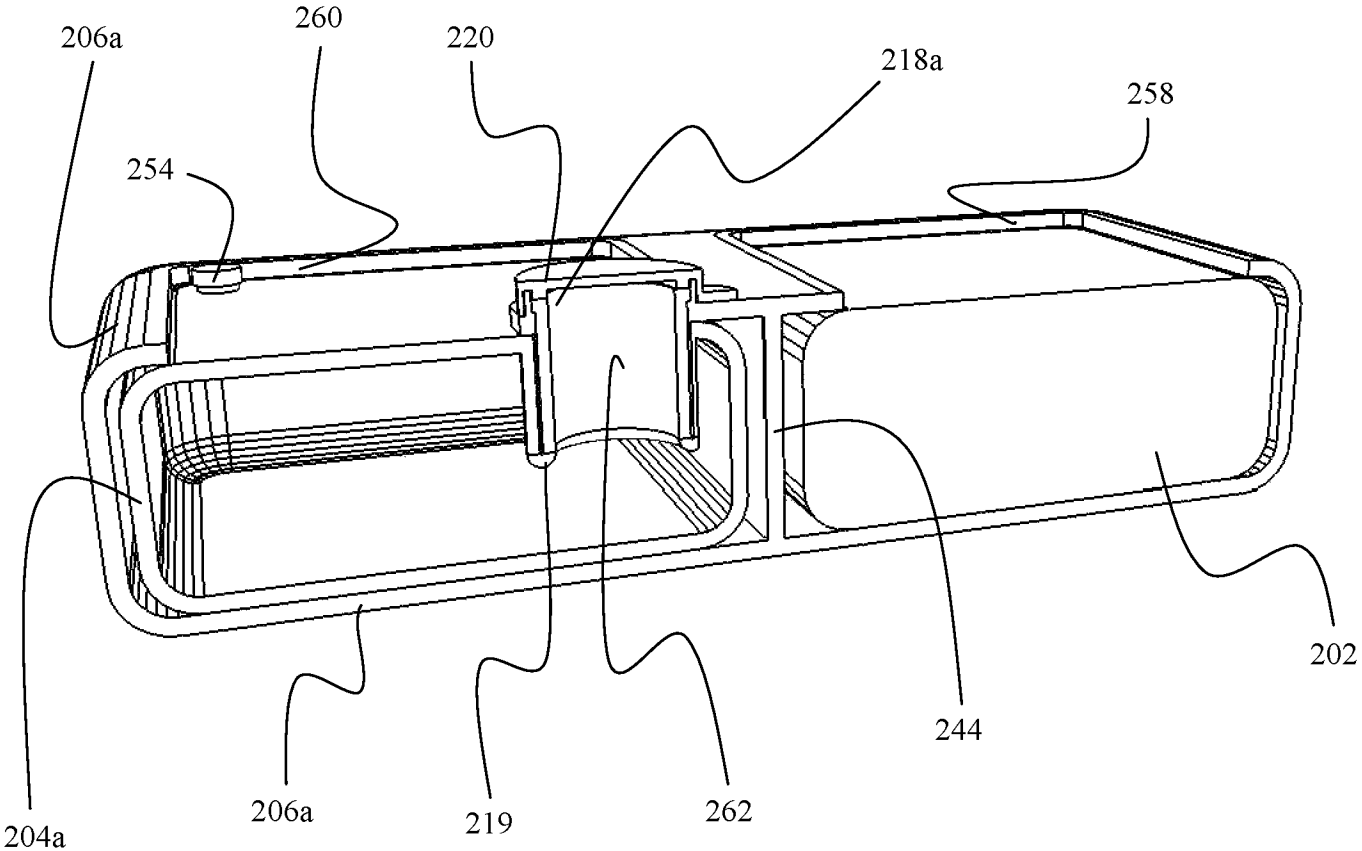
FIG. 17 is a fragmentary view of another embodiment of the moisture pad according to the present invention showing the filling opening of the reservoir connected to the reservoir by an extendable conduit in the form of a flexible tube that is folded over on itself.

Referring to FIG. 17, an alternative design for the filling opening **218*a* of the reservoir 204*a* can be seen. As the reservoir is pressed, a force or stress will be experienced by the attachment between the filling open and the container 206 and 206*a* tending to pull the filling opening into the container, which could lead to the filling opening being pulled out of its attachment with the container if excessive force is applied. To reduce this stress, an extendable conduit 262 has been provided for connecting the filling opening 218*a* to the reservoir 204*a*. As with the vent 254, the filling opening 218 need not be attached or fixed to the container 206**, which would obviate the need for the extendable conduit.

Figure 18:
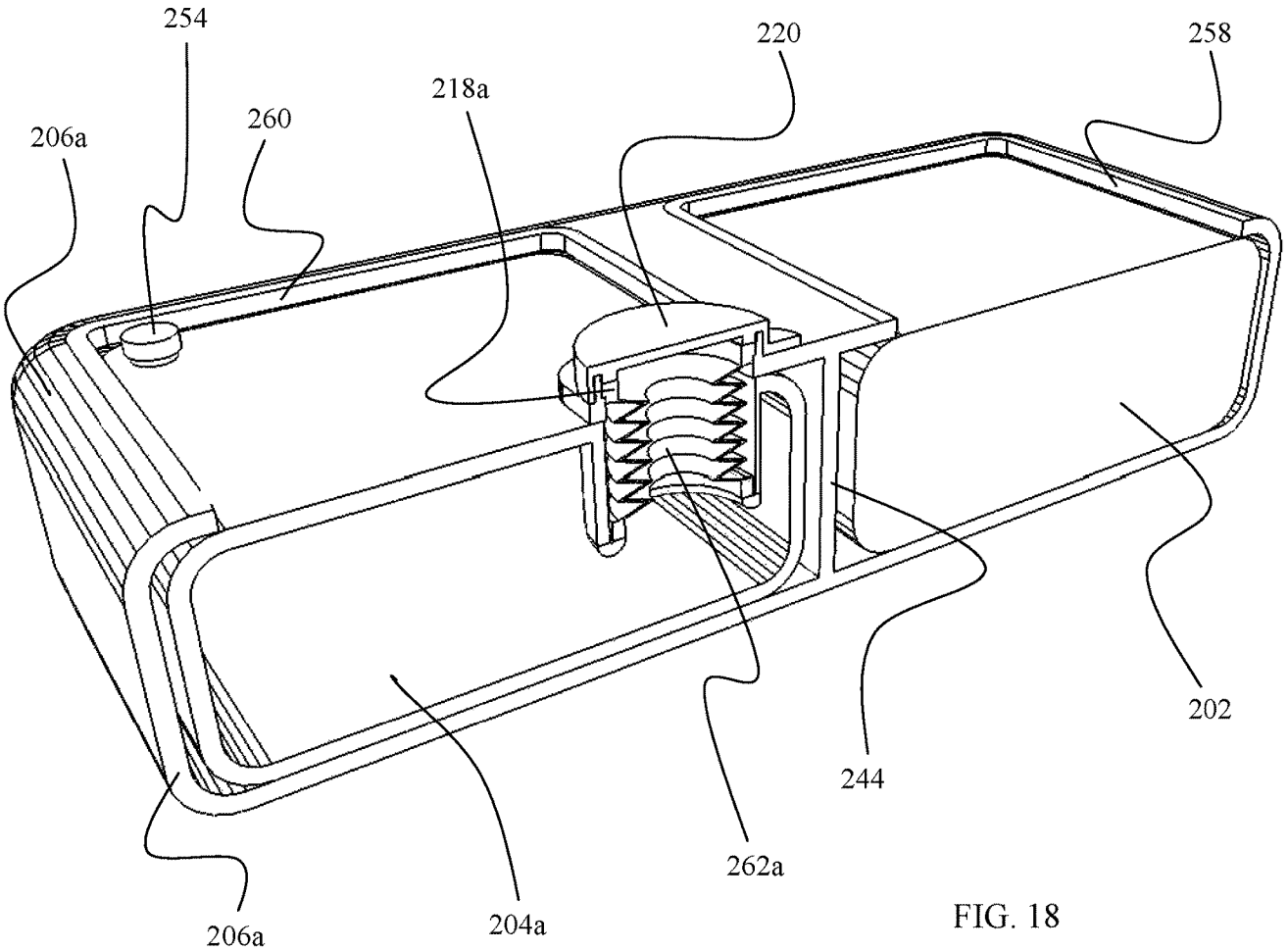
FIG. 18 is a fragmentary view of another embodiment of the moisture pad according to the present invention showing the filling opening of the reservoir connected to the reservoir by an extendable conduit in the form of a flexible accordion-like tube.

In FIG. 17, the extendable conduit 262 is in the form of a flexible, elongated, and tubular sleeve that has been folded over on itself in an inside out fashion at about its middle. As the reservoir **204*a* is depressed, the fold 219 moves away from the fixed end of the sleeve, i.e. the filing opening 218*a*, and thus allows the sleeve 262 to extend. As an alternative, shown in FIG. 18, an extendable conduit 262*a* can be used to connect the filling opening 218*a* to the reservoir 204*a*. The extendable conduit 262*a*** is in the form of a flexible tube with a wall having multiple folds along its length in a bellows or concertina or accordion fashion. As the reservoir is depressed, the folds open or expand to allow the tube to extend.

Similarly, if the vent 254 is attached in a fixed position to the container 206, the vent could be connected to the reservoir via an extendable conduit to reduce the stress on the attachment of the vent with the container when the reservoir is depressed. This concept is illustrated in FIGS. 19-23. As shown in FIGS. 20-23, an extendable conduit 364 has been provided for connecting the vent 354 to the reservoir 304. The extendable conduit 364 is in the form of a flexible tube with a wall having multiple folds along its length in a bellows or concertina or accordion fashion. As the reservoir 304 is depressed, the folds open or expand to allow the tube to extend.

Figure 19:
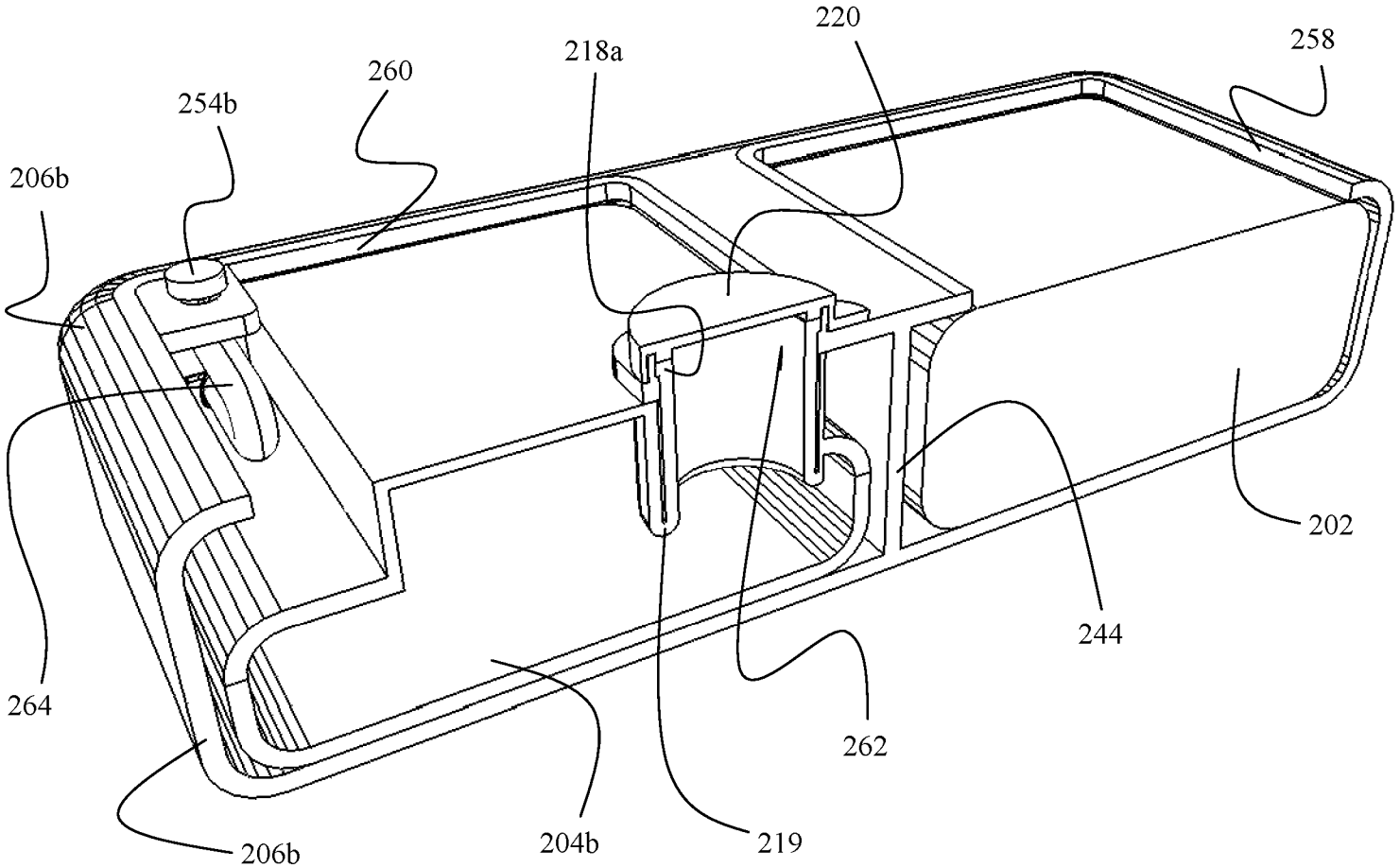
FIG. 19 is a fragmentary view of another embodiment of the moisture pad according to the present invention showing the filling opening of the reservoir connected to the reservoir by an extendable conduit in the form of an elongated flexible tube that is bent into a U shape.
Figure 20:
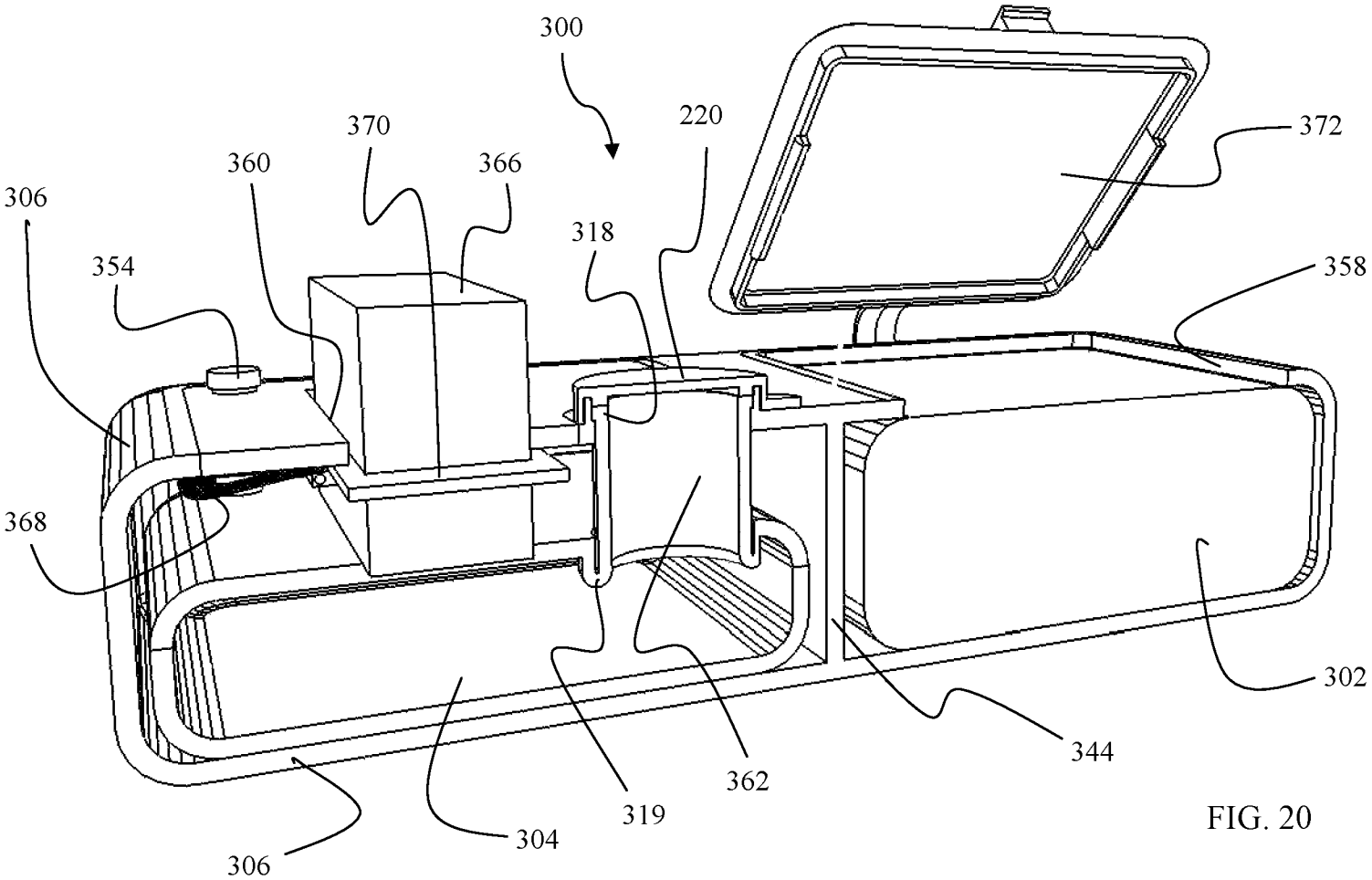
FIGS. 20-23 are views of yet another embodiment of the moisture pad according to the present invention, where the water reservoir is squeezed by a pressable member rather than being squeezed directly by the user's fingers.
Figure 21:
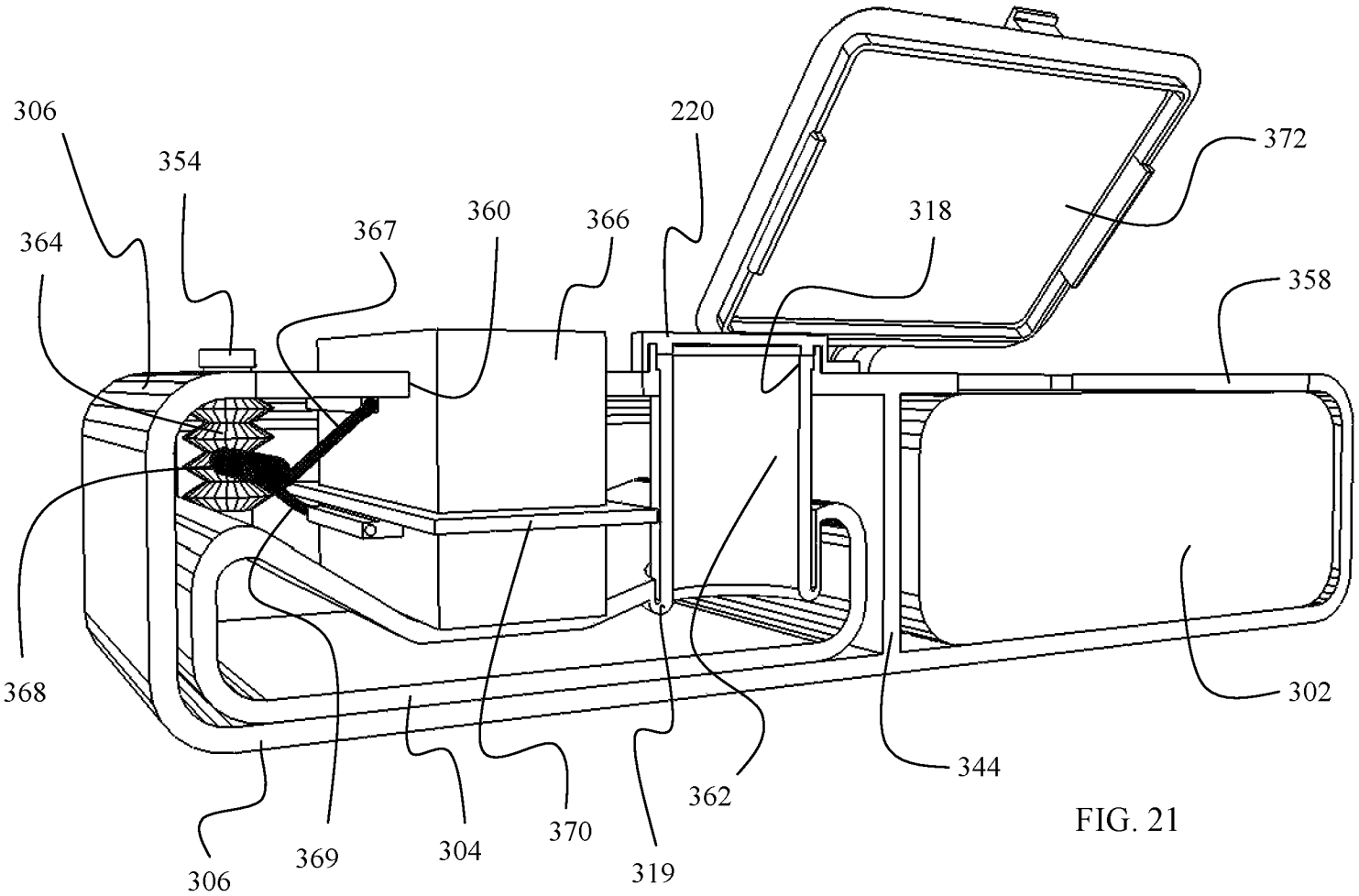

As an alternative, shown in FIG. 19, an extendable conduit 264 can be used to connect the vent 254*b*, which is fixed to the container 206*b*, to the reservoir 204*b*. The extendable conduit 264 is in the form of a flexible tube with a bend in it. The tube is extendable in the sense that its ends can move farther apart as the sides of the bend in the tube move apart. As the reservoir is depressed, the bend opens or expands to allow the tube to extend.

Referring to FIGS. 20-23, another embodiment of the moisture pad 300 can be seen. The moisture pad 300 includes a porous pad 302, for example a sponge; a water bladder or reservoir 304; and a container 306 for securely supporting the porous pad 302 and the reservoir 304. The moisture pad 300 further includes a pressable member 366. The pressable member 366 is pressed by the user to squeeze the reservoir 304 in order to expel water from reservoir 304 in order to wet porous pad 302. The pressable member 366 is in the form of a rectilinearly movable push button. The push button 366 is movable between an extended and a retracted position. The push button 366 is biased toward the extended position by the spring 368, which is of the torsion spring type in the illustrated embodiment. The torsion spring 368 has two arms 367 and 369. The first arm 367 is fixed to the container 306, and the second arm 369 is fixed to the push button 366. As the push button 366 is pushed inward relative to the container 306, the arms 367 and 369 of the torsion spring 368 are spread apart and wind up the coils of the torsion spring more tightly. When the push button is released, the unwinding coils of the torsion spring 368 bring the arms 367 and 369 back together and, in the process, return the push button 366 back to the extended position. In the extended position, the push button 366 projects outward from the container 306 to the maximum extent. When the push button 366 is pushed inward relative to the container 306, the push button 366 moves toward the retracted position.

The container 306 has two side by side compartments, one for the porous pad 302 and one for the reservoir 304. The two compartments of the container 306 are separated by a wall 344. The container 306 has two top openings 358 and 360. The opening 358 allows a user to press or squeeze the porous pad 302. The opening 360 provides enough clearance to allow the outward projecting portion of the push button 366 to extend through the opening 360. The push button 366 has a flange 370 that is too large to fit through the opening 360 and thus limits the outward projection of the push button 366. When the button 366 is pushed inward it squeezes the reservoir 304 and supplies water to the porous pad 302. The opening 358 is preferably provided with a closure 372 that snaps into the closed position over the opening 358. The closure 372 is snap fitted to the opening 358 for securing the closure 372 in the closed position over the opening 358.

As shown in FIGS. 20-23, an extendable conduit 362 can be used to connect the filling opening 318 to the reservoir 304. The extendable conduit 362 is in the form of a flexible, elongated, and tubular sleeve that has been folded over on itself in an inside out fashion. As the reservoir is depressed, less and less of the length remains in the folded-over configuration such that, as a result, the sleeve extends. Put another way, as the reservoir 304 is depressed, the fold 319 moves away from the fixed end of the sleeve, i.e. the filing opening 318, and thus allows the sleeve 362 to extend.

Figure 22:
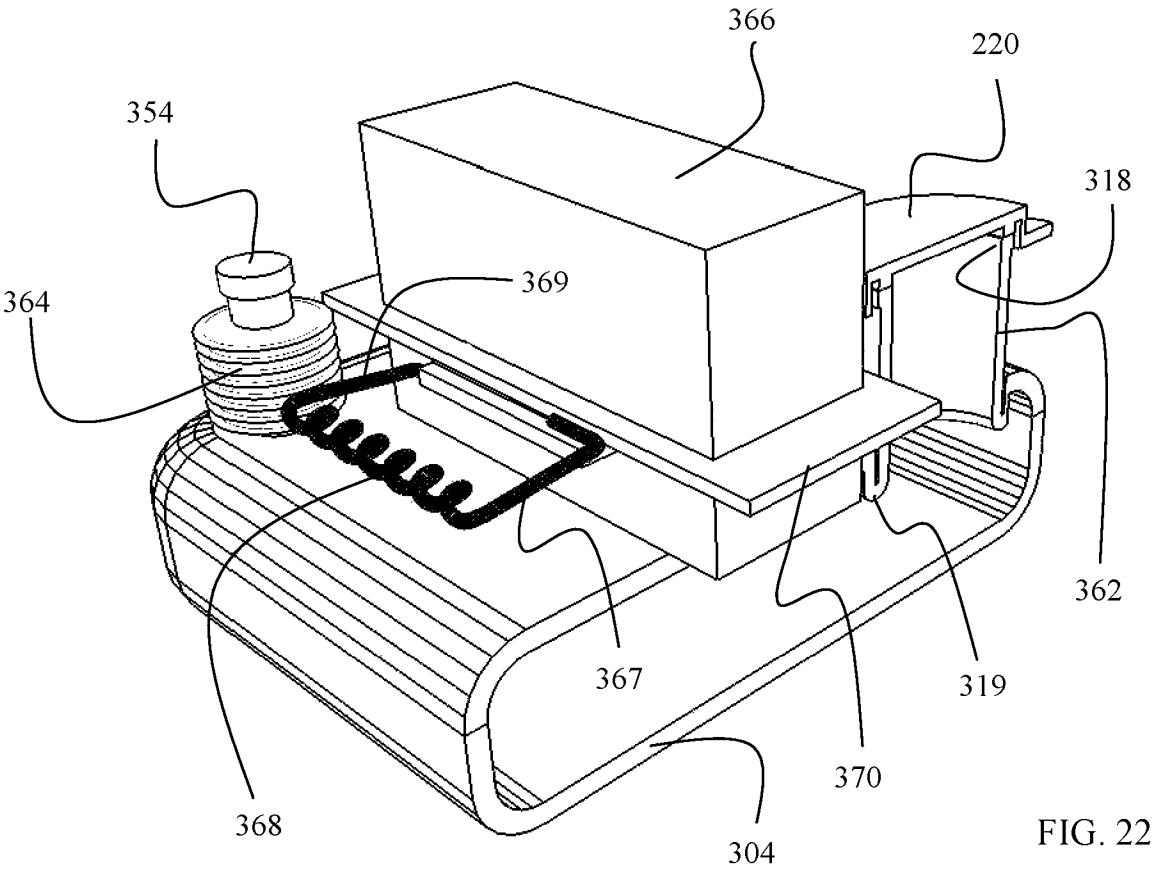
Figure 23:
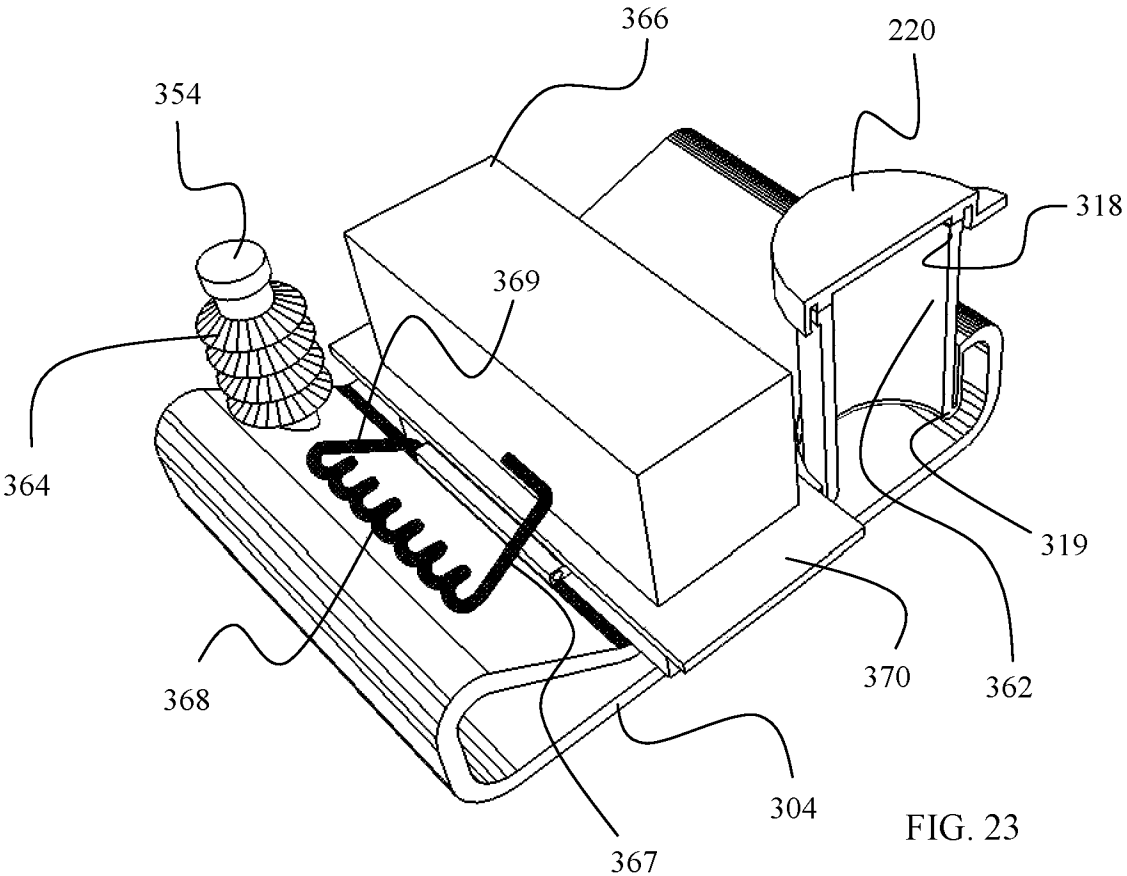
Figure 24:
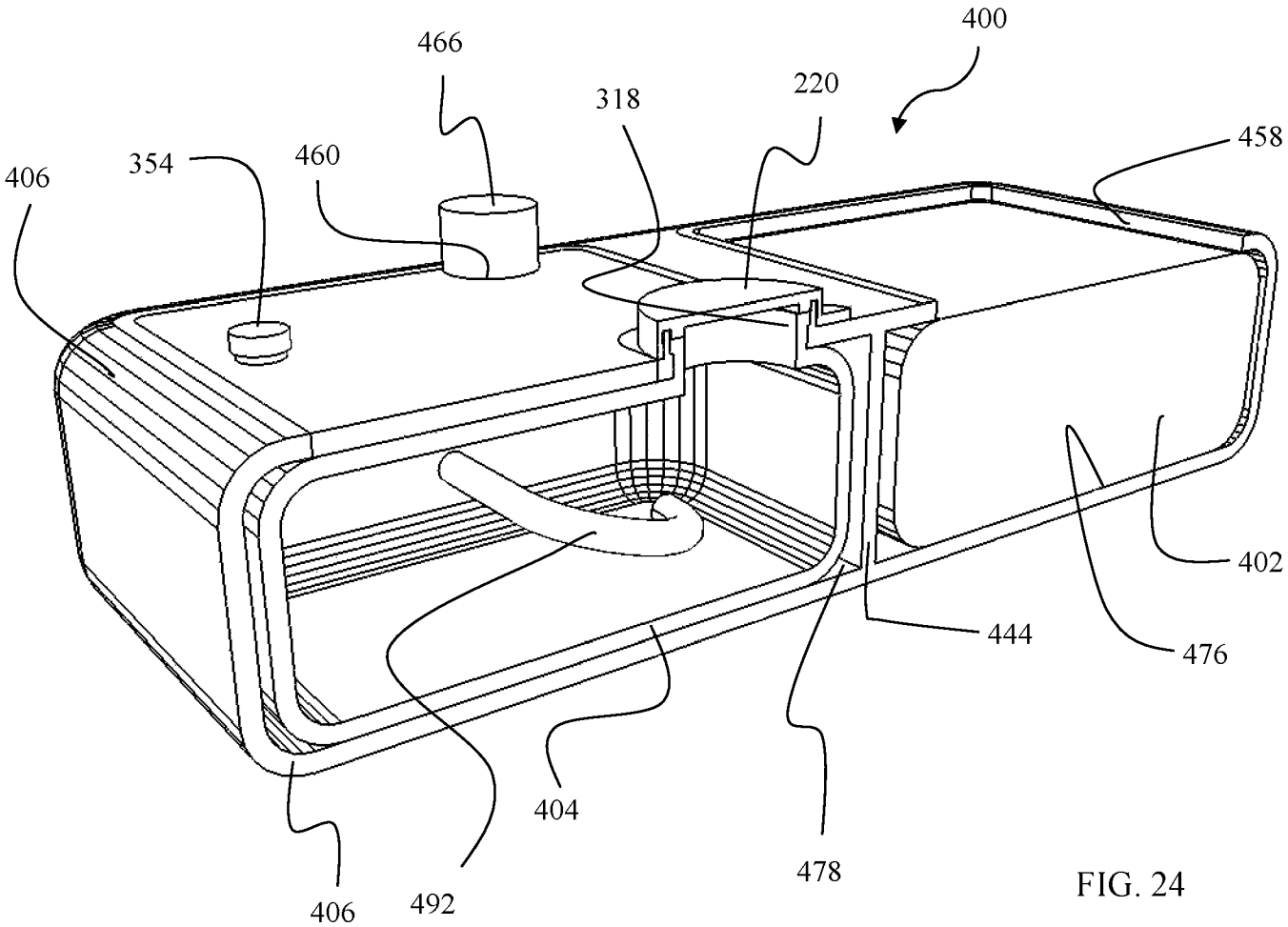
FIGS. 24-31 are views of yet another embodiment of the moisture pad according to the present invention, wherein the water reservoir is rigid and wherein water is supplied from the reservoir to the sponge using a pump operated by a push button.
Figure 25:
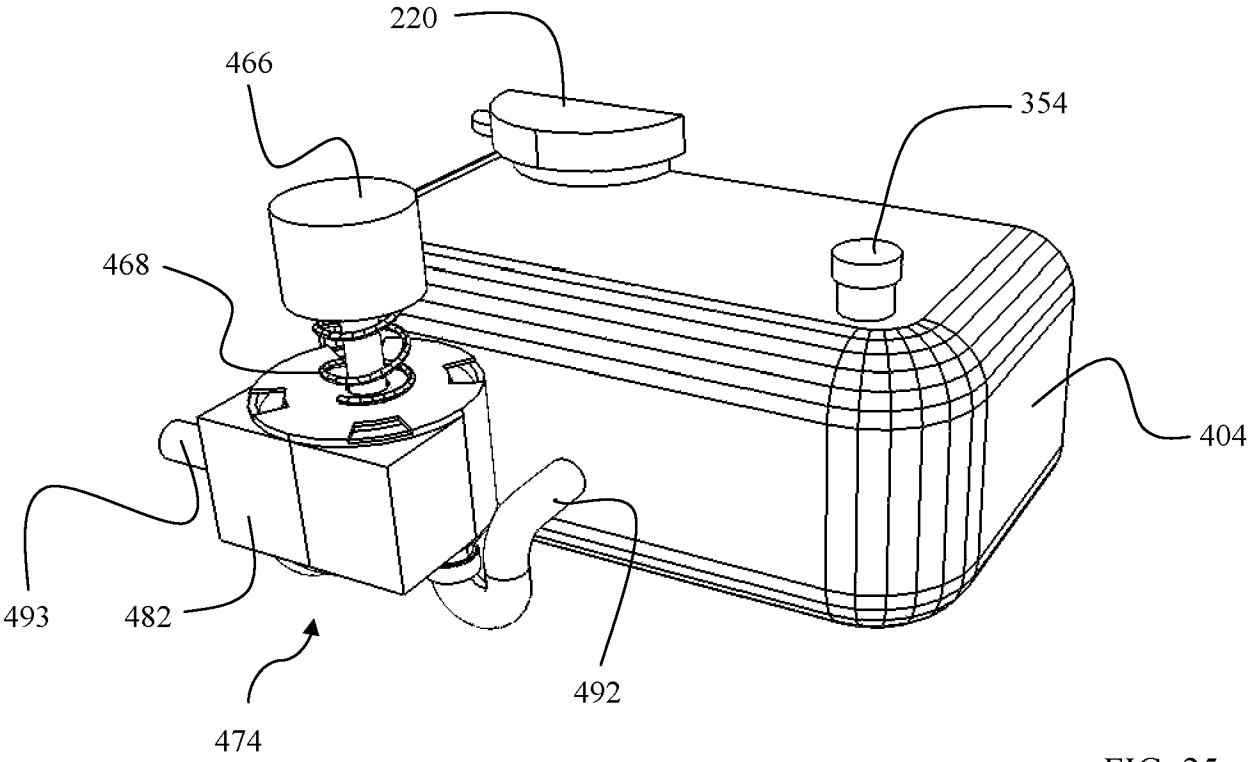
Figure 26:
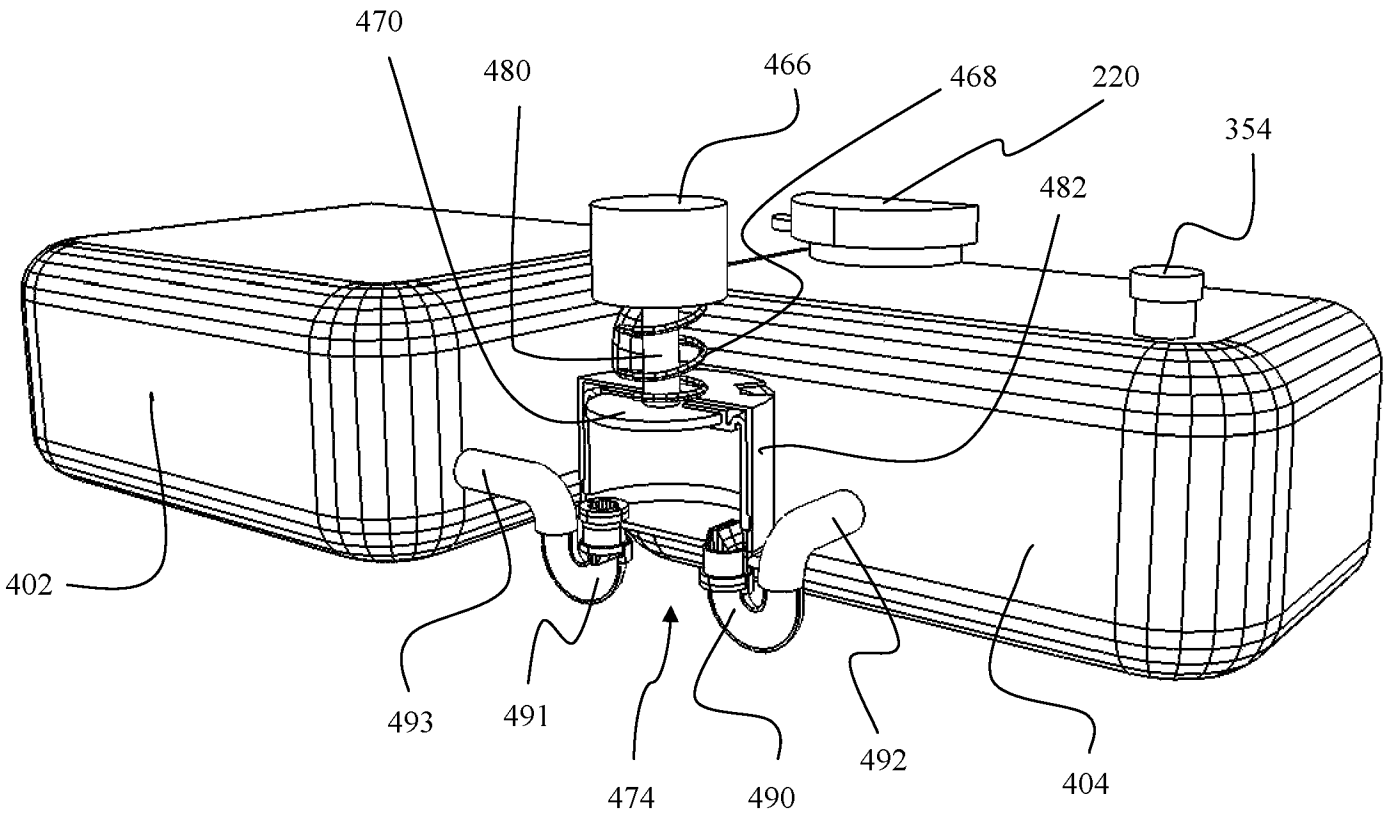
Figure 27:
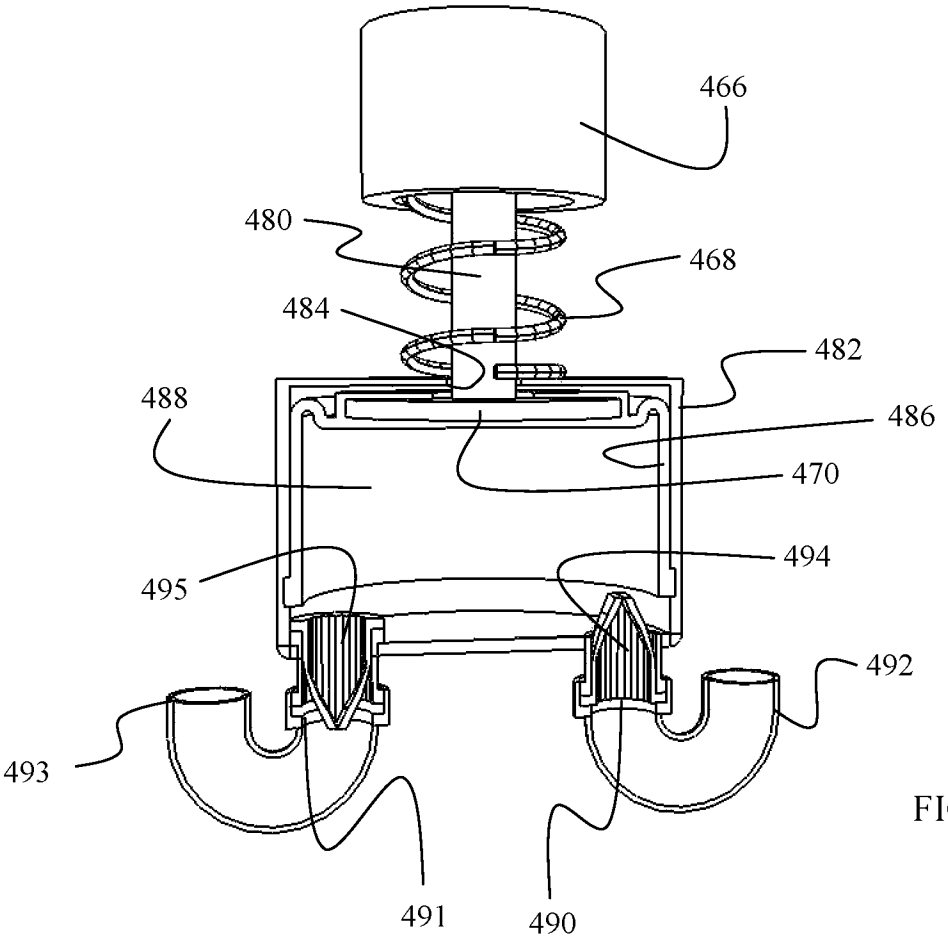
Figure 28:
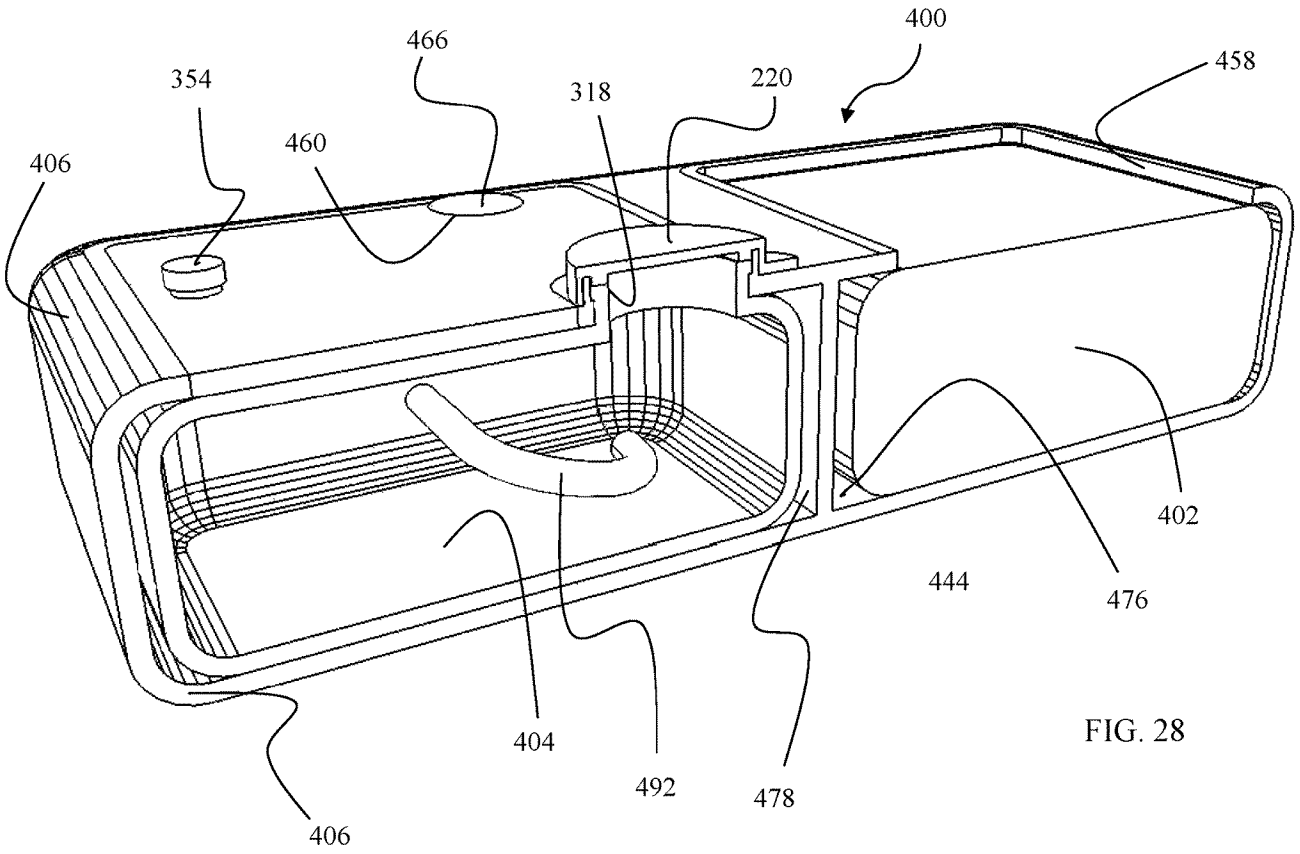
Figure 29:
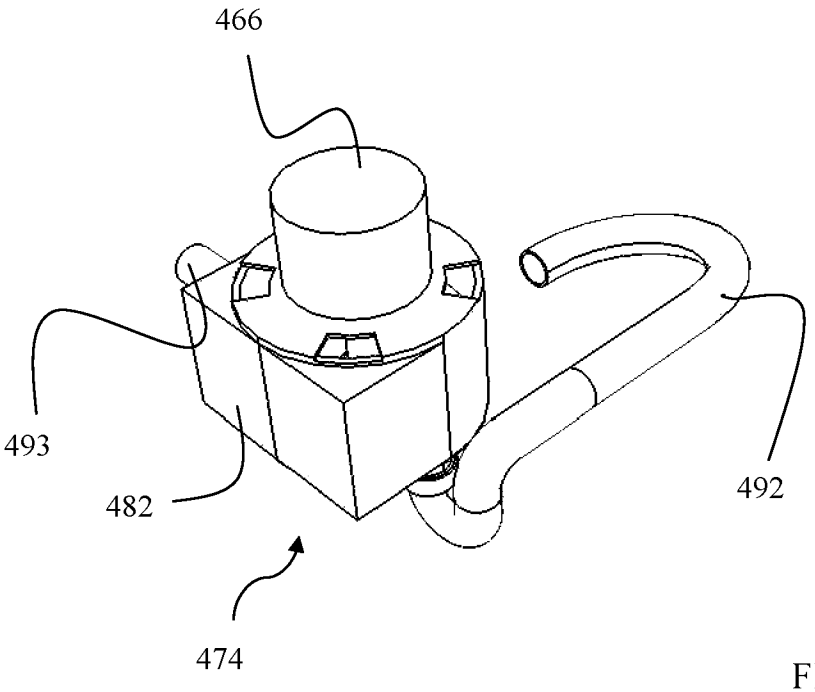
Figure 30:
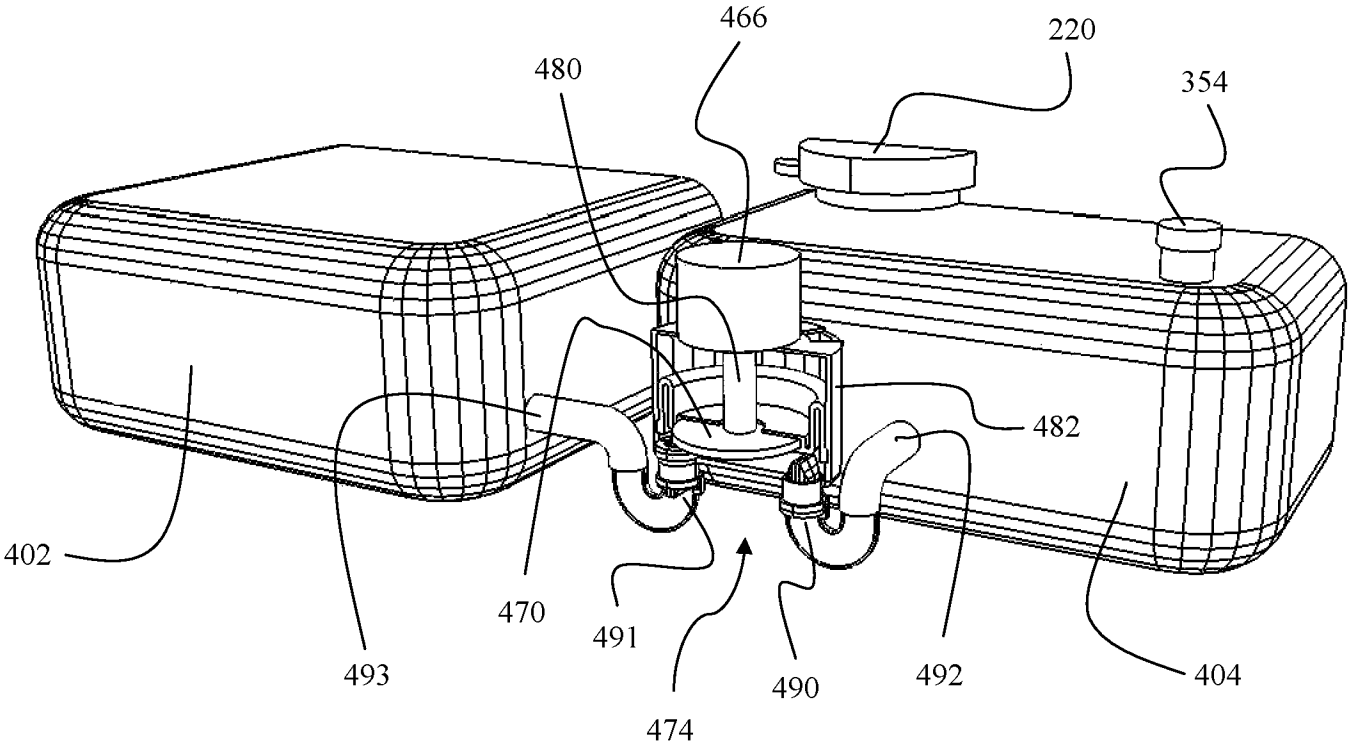
Figure 31:
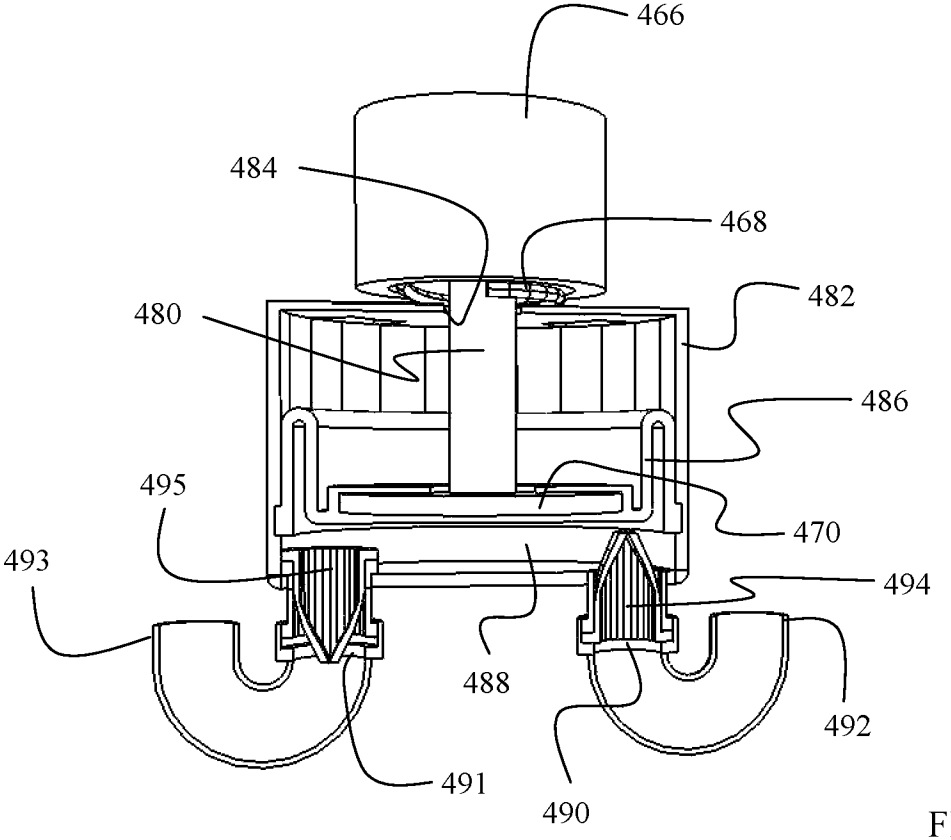

Similarly, if the vent 354 is attached to the container 306 at a fixed position relative to the container 306, the vent 354 could be connected to the reservoir 304 via an extendable conduit to reduce the stress on the attachment of the vent with the container when the reservoir is depressed. As shown in FIGS. 22-23, an extendable conduit 364 has been provided for connecting the vent 354 to the reservoir 304. The extendable conduit 364 is in the form of a flexible tube with a wall having multiple folds along its length in a bellows or concertina or accordion fashion. As the reservoir 304 is depressed, the folds open or expand to allow the tube to extend.

Referring to FIGS. 24-31, another embodiment of the moisture pad 400 can be seen. The moisture pad 400 includes a porous pad 402, for example a sponge; a water reservoir 404, which is rigid; and a container 406 for securely supporting the porous pad 402 and the reservoir 404. The moisture pad 400 further includes a pressable member 466. The pressable member 466 is pressed by the user to operate the pump 474 in order to supply water from reservoir 404 to the compartment 476 in order to wet the porous pad 402. The pressable member 466 is in the form of a rectilinearly movable push button. The push button 466 is movable between an extended and a retracted position. The push button 466 is biased toward the extended position by the spring 468, which is of the compression, coil spring type in the illustrated embodiment. In the extended position, the push button 466 projects outward from the container 406 to the maximum extent. When the push button 466 is pushed inward relative to the container 406, the push button 466 moves toward the retracted position.

The container 406 has two side by side compartments 476 and 478. The compartment 476 houses the porous pad 402, and the compartment 478 houses the reservoir 404. The two compartments of the container 406 are separated by a wall 444. The container 406 has two top openings 458 and 460. The opening 458 allows a user to press or squeeze the porous pad 402. The opening 460 provides enough clearance to allow the outward projecting portion of the push button 466 to extend through the opening 460. The push button 466 is connected to a plate or piston 470 by a shaft 480. The piston 470 is located inside the pump housing 482. The top of the pump housing 482 has an opening or hole 484 that provides enough clearance for the shaft 480 to slide through the opening 484, but the piston 470 is too large to fit through the opening 484 and thus limits the outward projection of the push button 466. The spring 468 surrounds the shaft 480 and acts between the top of the pump housing 482 and the push button 466 to bias the button 466 toward the extended position.

The piston 470 is embedded in the pump bellows or diaphragm 486. The bellows 486 and the pump housing 482 cooperatively form a sealed, variable volume pumping chamber 488. When the button 466 is pushed inward, the piston 470 is pushed farther into the pump housing 482 toward the bottom of the pump housing, which collapses the bellows 486 and reduces the volume of the pumping chamber 488 to eject water from the pumping chamber 488 and in turn from the pump 474. When the button 466 is released, the spring 468 pushes the button 466 toward the extended position and moves the piston 470 away from the bottom of the pump housing, which expands the bellows 486 and increases the volume of the pumping chamber 488 to draw water into the pumping chamber 488 and in turn into the pump 474. The bellows 486 has a peripheral sleeve that is folded over on itself in outside-in fashion. As the piston 470 moves toward the bottom of the pump housing 482, more of the peripheral sleeve of the bellows is folded inward on itself allowing the bellows to collapse farther and reduce the volume of the pumping chamber 488. As the piston 470 moves toward the top of the pump housing 482, less of the peripheral sleeve of the bellows is folded inward on itself allowing the bellows to expand farther and increase the volume of the pumping chamber 488.

The pump 474 has an inlet 490 and an outlet 491. The pump inlet 490 is in fluid communication with the reservoir 404 via the inlet conduit 492. The pump outlet 491 is in fluid communication with the compartment 476, and in turn with the porous pad 402, via the outlet conduit 493. An inlet one-way valve 494 allows water to flow from the reservoir 404 to the pump 474 and prevents flow from the pump 474 to reservoir 404. An outlet one-way valve 495 allows water to flow from the pump 474 to the pad compartment 476 and prevents flow from the pad compartment 476 to the pump 474. The pressable member 466, a push button in the illustrated example, can be pressed by the user to operate the pump 474 in order to supply water from the reservoir 404 to the pad compartment 476 and thus wet the porous pad 402.

In the illustrated example, the one-way valves 494 and 495 are slit valves. Any suitable type of one-way valve, including captive ball valves and any of the other types of one-way valves referred to previously, may be used in the moisture pad device 400. A convergent-divergent nozzle, or any other type of suitable nozzle, may be provided at the point where water issues from the conduit 493 into the compartment 476, in other words at the outlet of the conduit 493, if desired. The moisture pad device 400 may also be provided with any of the types of closures 208 or 372 previously discussed.

When the button 466 is pushed inward it squeezes the pumping chamber 488 and supplies water to the porous pad 402.

Figure 32:
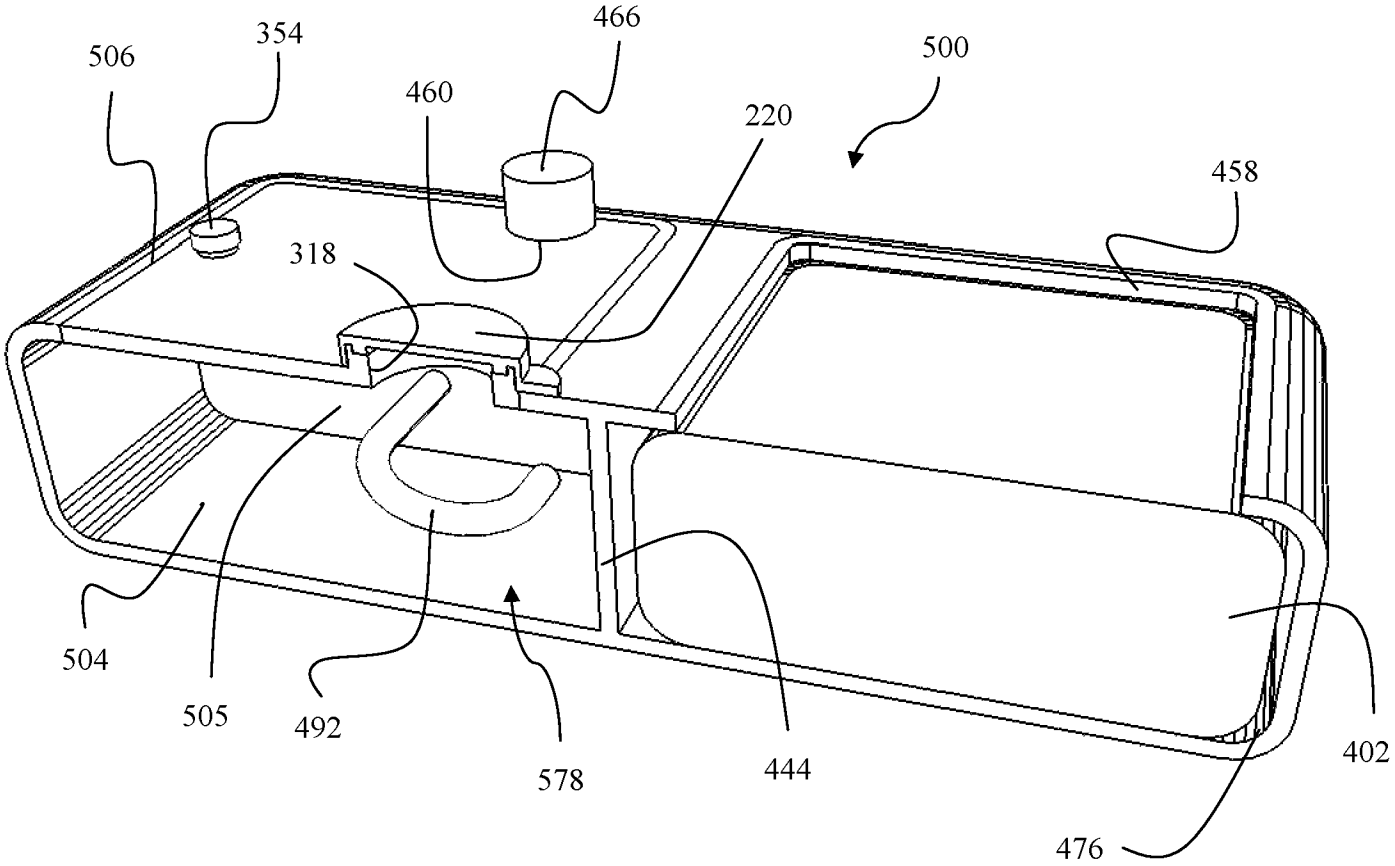
FIGS. 32-33 are views of yet another embodiment of the moisture pad according to the present invention, wherein the water reservoir is integral with a container that also houses the sponge and wherein water is supplied from the reservoir to the sponge using a pump operated by a push button.
Figure 33:
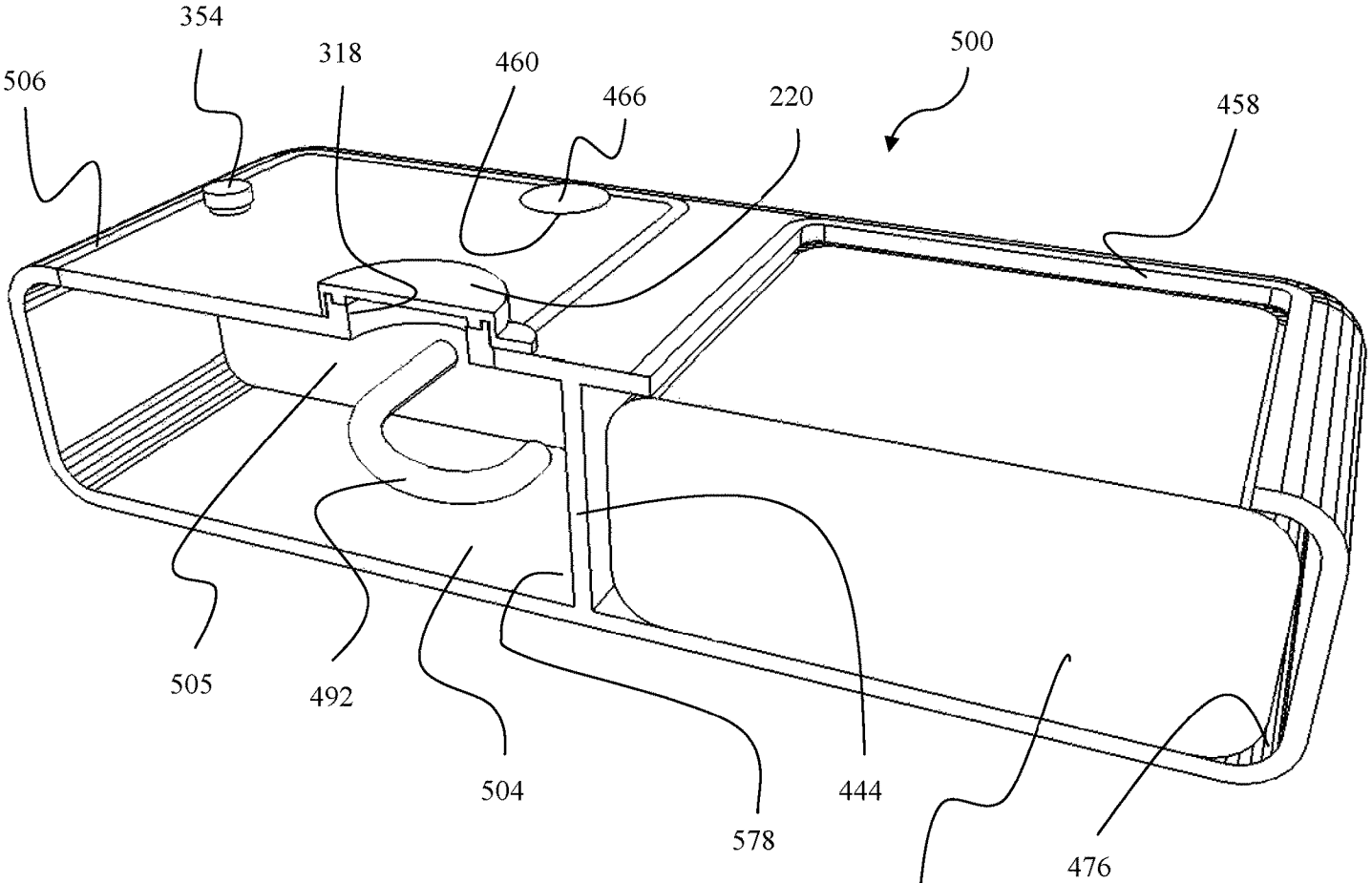

Referring to FIGS. 32-33, another embodiment of the moisture pad 500 can be seen. The moisture pad 500 has a reservoir 504 that is an integral part of the container 506. In other words, the reservoir 504 is formed at least in part from the walls of the container 506. In the illustrated example, the partition wall 505 is added to the compartment 578 to form the reservoir 504. The moisture pad device 500 is otherwise identical to the moisture pad device 400.

In all other respects, the embodiments of FIGS. 17-33 are identical to the embodiment of FIGS. 1-11. The reservoir and/or the container (e.g. 204, 504 and/or 206, 506) are preferably made of transparent material to allow a person using the moisture pad device to determine by inspection whether or not water needs to be added to the reservoir. The attachment between the strap or band 210 and the container may be offset toward the porous pad or toward the reservoir, rather than being longitudinally centered relative to the container, if needed to allow the moisture pad device to be more comfortably worn about the wrist area.

It must be understood that all permutations of the features of the various disclosed embodiments are contemplated as being part of the present invention. It is to be understood that the present invention is not limited to the embodiments described above, but encompasses any and all embodiments within the scope of the following claims.

The invention claimed is:

1. A moisture pad comprising:

a porous pad for holding a quantity of absorbed water, said porous pad wetting one or more of a user's fingers with a portion of the quantity of water absorbed therein when said porous pad having the quantity of water absorbed therein is pressed by the one or more of the users fingers;

a reservoir for holding a quantity of water in reserve, water from said reservoir wetting said porous pad under the control of the user;

a container for supporting said porous pad and said reservoir, wherein the container comprises a pad compartment housing said porous pad, said pad compartment and said reservoir being arranged side by side, said reservoir being separated from said porous pad by a wall, said container having opening configured to allow a user to press or squeeze said porous pad;

a one-way valve configured to allow water originating from said reservoir to be applied to said porous pad when said one-way valve is open, wherein said reservoir is a squeezable reservoir such that water from said reservoir wets said porous pad when said reservoir is squeezed by the user while said reservoir holds at least some water; and a filling opening for said reservoir, wherein said filling opening is connected to said reservoir by an extendable conduit so that a stress placed on an attachment between the filling open and the container when squeezing said reservoir is reduced.

2. The moisture pad according to claim 1, further comprising a strap for holding the moisture pad on a person's body.

3. The moisture pad according to claim 1, further comprising a closure for said container.

4. The moisture pad according to claim 1, further comprising a strap for holding the moisture pad on a person's body.

5. The moisture pad according to claim 2, further comprising a closure for said container.

6. The moisture pad according to claim 5, further comprising a squeezable reservoir for holding a quantity of water in reserve, water from said reservoir wetting said porous pad when said reservoir is squeezed by the user while said reservoir holds at least some water.

7. The moisture pad according to claim 4, further comprising a pressable member, wherein the pressable member is pressed by the user to squeeze said reservoir in order to expel water from said reservoir so as to wet said porous pad.

8. The moisture pad according to claim 1, further comprising a pressable member, wherein the pressable member is pressed by the user to squeeze said reservoir in order to expel water from said reservoir so as to wet said porous pad.

9. The moisture pad according to claim 1, wherein said one-way valve is an outlet one-way valve configured to allow water to flow from said pump to said pad compartment and prevent flow from said pad compartment to said pump, the moisture pad further comprising:

a pump having an inlet and an outlet, said pump inlet communicating with said reservoir and said pump outlet communicating with said pad compartment;

an inlet one-way valve to allow water to flow from said reservoir to said pump and prevent flow from said pump to said reservoir; and a pressable member that can be pressed by the user to operate said pump in order to supply water from said reservoir to said pad compartment and wet said porous pad.

10. The moisture pad according to claim 9, wherein said reservoir is an integral part of said container.

11. The moisture pad according to claim 4, wherein the one-way valve is an outlet one-way valve configured to allow water to flow from said pump to said pad compartment and prevent flow from said pad compartment to said pump, the moisture pad further comprising:

a pump having an inlet and an outlet, said pump inlet communicating with said reservoir and said pump outlet communicating with said pad compartment;

an inlet one-way valve to allow water to flow from said reservoir to said pump and prevent flow from said pump to said reservoir; and a pressable member that can be pressed by the user to operate said pump in order to supply water from said reservoir to said pad compartment and wet said porous pad while said reservoir holds at least some water.

12. The moisture pad according to claim 11, wherein said reservoir is an integral part of said container.

* * * * *